US005602742A

United States Patent [19]

Solondz et al.

[11] Patent Number: 5,602,742

[45] Date of Patent: Feb. 11, 1997

[54] POSTAGE METERING SYSTEM

[76] Inventors: Leonard I. Solondz, 28 Fordham Rd., Livingston, N.J. 07039; Roger C. Gore, 2156 Buttonwood Plain, Scotchplains, N.J. 07076

[21] Appl. No.: 370,845

[22] Filed: Jan. 10, 1995

[51] Int. Cl.[6] ..... G07B 17/00

[52] U.S. Cl. ..... 364/464.2; 364/464.19; 364/464.13

[58] Field of Search ..... 364/464.02, 464.03

[56] References Cited

U.S. PATENT DOCUMENTS

| | | | |
|---|---|---|---|
| 4,286,325 | 8/1981 | Dlugos et al. | 364/464.03 |
| 4,325,440 | 4/1982 | Crowley et al. | 177/25.15 |
| 4,495,581 | 1/1985 | Piccione | 364/464.03 |
| 4,800,504 | 1/1989 | Durst, Jr. et al. | 364/464.02 X |
| 4,812,994 | 3/1989 | Taylor et al. | 364/464.02 |
| 4,831,555 | 5/1989 | Sansone et al. | 364/464.02 X |
| 4,837,701 | 6/1989 | Sansone et al. | 364/464.03 |
| 4901,241 | 2/1990 | Schneck | 364/464.02 |
| 4,908,770 | 3/1990 | Breault et al. | 364/464.02 |
| 5,117,364 | 5/1992 | Barns-Slavin et al. | 364/464.03 |
| 5,233,532 | 8/1993 | Ramsden | 364/464.03 |
| 5,265,033 | 11/1993 | Vajk et al. | 364/514 C |
| 5,309,363 | 5/1994 | Graves et al. | 364/464.02 |
| 5,337,246 | 8/1994 | Carroll et al. | 364/464.02 |
| 5,340,948 | 8/1994 | Ramsden | 364/464.03 X |
| 5,369,221 | 11/1994 | Ramsden | 364/464.03 X |
| 5,473,143 | 12/1995 | Vak et al. | 235/380 |
| 5,481,464 | 1/1996 | Ramsden | 364/464.03 |
| 5,490,077 | 2/1996 | Freytag | 364/464.02 |

*Primary Examiner*—Edward R. Cosimano
*Attorney, Agent, or Firm*—Siegmar Silber, Esq.

[57] ABSTRACT

A postage management system is disclosed that enables the use of one of a plurality of carriers from any station in the network. The system imprints postage on postal and private courier parcels and envelopes. Each station of the system has a central processing unit (CPU), an operating system, and a user communications link with the CPU having an embedded software program therewithin. The software program has a permanent portion and a configurable portion, and the configurable portion, in turn, has a postage rate database, a postage service database, and a management program. The databases include on a carrier-by-carrier basis the postal costs for parcels and envelopes of various configurations and specifications for a various parcel and envelope configurations, respectively. The system software includes both user and system default parameter schemes enabling a user to predetermine common patterns of use and quickly employ a given modality. The permanent portion of the embedded software has a rate comparator program which operates with the management program to provide optimization of services.

19 Claims, 25 Drawing Sheets

90
START
92
ENTER PASSWORD
94
IS PASSWORD VALID ?
NO
96
DISPLAY ERROR MESSAGE
YES
98
BEGIN LOOP
100
QUICK PRINT
NO
YES
A
102
BUY POSTAGE
NO
YES
B
104
POSTAGE CALCULATOR
NO
YES
C
106
POSTAGE BY SERVICE
NO
YES
D
108
COMMUNICATIONS
YES
E
NO
110
REPORTS
NO
YES
F
112
PROGRAMING
NO
YES
G
114
END LOOP

C
160
RECOMMEND CARRIER?
NO
162
ENTER CARRIER #
YES
164
RECOMMEND CLASS
NO
166
ENTER CLASS
YES
168
ENTER WEIGHT
170
ENTER DESTINATION ZIP CODE
172
ENTER ORIGINATING ZIP CODE
176
INVALID DATA
174
IS DATA VALID
NO
YES
178
CALCULATE POSTAGE
180
DISPLAY POSTAGE & CARRIER
B
YES
182
PRINT POSTAGE?
YES
184
BALANCE AVAILABLE?
NO
186
INSUFFICIENT BALANCE
188
GO TO BUY POSTAGE?
NO
128
RETURN
YES
190
PRINT POSTAGE
128
RETURN
NO
128
RETURN

G

260
BEGIN
LOOP
262
USER
DEFAULTS
NO
264
USER
NO
266
POSTAGE
ACCOUNTS
NO
YES
YES
YES
G.A
G.B
G.C
268
COUNTRY
NO
270
COMPUTER
INTERFACE
NO
272
PASSWORD
PROTECTION
NO
274
ACCOUNT
CODES
NO
YES
YES
YES
YES
G.D
G.E
G.F
G.G
276
TIME/DATE SET
NO
278
CARRIERS
NO
280
GRAPHICS
NO
282
END
LOOP
YES
YES
YES
G.H
G.I
G.J

POSTAGE METERING SYSTEM

BACKGROUND OF THE INVENTION

1. Field of the invention

This invention relates to a system that provides for franking postage for any given country; purchasing private courier postage; comparing rates of various courier services; optimizing postage rates; purchasing telephonically postage for the necessary service; tracking customer usage; and, printing the postmark of the corresponding service and amount directly on the parcel envelope or specially designed labels.

2. Background of the Prior Art

In preparing for this application, several U.S. patents became known to the inventors hereof. This resulted from a review of Class 364/Subclasses 464.02 and 464.03, which uncovered the following patents:

| ITEM NO. | U.S. Pat. No. | INVENTOR | ISSUE DATE |
|---|---|---|---|
| 1 | 4,511,793 | Racanelli | 04/16/1985 |
| 2 | 4,837,701 | Sansone et al. | 06/06/1989 |
| 3 | 4,900,904 | Wright et al. | 02/13/1990 |
| 4 | 4,949,272 | Vanourek et al. | 08/14/1990 |
| 5 | 4,998,204 | Sansone et al. | 03/05/1991 |
| 6 | 5,024,282 | Raikes et al. | 06/18/1991 |
| 7 | 5,040,132 | Schuricht et al. | 08/13/1991 |
| 8 | 5,065,000 | Pusic | 11/12/1991 |
| 9 | 5,068,797 | Sansone et al. | 11/26/1991 |
| 10 | 5,070,463 | Schuricht et al. | 12/03/1991 |
| 11 | 5,077,792 | Herring | 12/31/1991 |
| 12 | 5,079,712 | Ileana et al. | 01/07/1992 |
| 13 | 5,117,364 | Barns-Slavin et al. | 05/26/1992 |
| 14 | 5,121,328 | Sakai et al. | 06/09/1992 |
| 15 | 5,124,926 | Barns-Slavin et al. | 06/23/199 |
| 16 | 5,161,109 | Keating et al. | 11/03/1992 |
| 17 | 5,233,532 | Ramsden | 08/03/1993 |
| 18 | 5,272,640 | Wu | 12/21/1993 |

U.S. Pat. No. 4,511,793—Racanelli

A mail metering machine having the ability to allocate postage costs among designated accounts using a bar code.

U.S. Pat. No. 4,837,701—Sansone et al.

The system enables mail sender to purchase postage from a central station, then process batches which will be accompanied by a statement summarizing the number of mail pieces and the amount of postage for each batch. The statement allows mail payment verification.

U.S. Pat. No. 4,900,904—Wright et al.

An automated transaction system employing portable rate cards having embedded memories for storing rate information corresponding to different services, and a terminal which receives an inserted rate card and operates to calculate the value of an item requested at the terminal by a user using the information stored on the rate card, and to dispense the requested item having the calculated value.

U.S. Pat. No. 4,949,272—Vanourek et al.

A communications system for processing information for distribution, including: a central data station, a plurality of user stations, a communication link interconnecting the user stations with the central data station, each user stations including means for accessing the central station, the central station including a data base of usage information and billing data, the central station including means for accessing the user station usage data base, the central data station including means responsive to the usage pattern for calculating a billing data.

U.S. Pat. No. 4,998,204—Sansone et al.

A system for processing batch mail in which the need for on-site inspection is unnecessary. The mail sender purchases postage from a central station thereby authorizing him to send mail equal to the amount of postage purchased.

U.S. Pat. No. 5,024,282—Raikes et al.

An electronic postal scale measuring the weight of an item in metric or in avoirdupois units. It calculates a postal or shipping rate for the item, in accordance with a stored rate table defined in either metric or avoirdupois units.

U.S. Pat. No. 5,040,132—Schuricht et al.

A system for preparing shipping documents includes a processor, keyboard, display, memory, and printer. Prepares shipping documents.

U.S. Pat. No. 5,065,000—Pusic

The invention discloses an automated electronically controlled postage meter including a mail weighing means, an alphanumerical keyboard, a direct bar code thermal transfer printer, a magnetic and IC card reader/write, a liquid crystal display, etc . . . Allows for weighing of postcards, envelopes, and packages; allows for payment by debit card, credit, or IC cards, cash, or check.

U.S. Pat. No. 5,068,797—Sansone et al.

A system and method for optimizing mail delivery of batch mail. A network is established interconnecting plural mail batch mailers, a data center, and the Postal Service. Data is transmitted, and data center can merge mail batches to expedite processing and delivery.

U.S. Pat. No. 5,070,463—Schuricht et al.

A parcel processing system provides shipping documents required for a number of shipping carriers and/or classes of service.

U.S. Pat. No. 5,077,792—Herring

Credit in a credit register of a franking meter is reset by telephone communication with a resetting terminal. A request for a selected credit amount is transmitted from the meter apparatus to the terminal and in response the terminal interrogates the meter to establish identity of the meter.

U.S. Pat. No. 5,079,712—Ileana et al.

A carrier management system includes accounting registers, and a program for setting the registers. The program may be responsive to the input of coded values for decoding these values and storing them in the registers. The program may be enabled, for a single operation, by insertion of a service PROM in the system.

U.S. Pat. No. 5,117,364—Barns-Slavin et al.

A carrier management system includes a scale for weighing parcels to be shipped, a computer connected to receive data from the scale related to the weight of a parcel thereon, and first input keys enabling the input of information.

U.S. Pat. No. 5,121,328—Sakai et al.

In a fee calculating apparatus for calculating a delivery fee, when weight data obtained by measurement in a weight measuring section such as an electronic scale, length data obtained by measurement in a length measuring section such as an automatic measure, and area data input by area data input means are all supplied to calculating means, a delivery fee is calculated from the data by the calculating means in accordance with the fee tables such as a parcel rank conversion table and a fee conversion table.

U.S. Pat. No. 5,124,926—Barns-Slavin et al.

A register system such as a carrier management system has a scale for weighing parcels, and a computer for determining shipping costs of the parcels.

U.S. Pat. No. 5,161,109—Keating et al.

A communication system for processing information for distribution, including: a communication link interconnecting the user stations with the central data stations, each the user station including means for accessing the central station, the central station including a data base of distribution information, the user station including means for accessing the central data station data base, the central data station including means responsive to the user usage pattern for providing data to the station which optimizes rate and time of distribution.

U.S. Pat. No. 5,233,532—Ramsden

A system for accepting and storing items for subsequent pickup by a commercial carrier may include a storage area which is defined by an outer housing, and a customer interface area that includes a weighing unit and a unit, such as a magnetic card reader, for accepting payment from a customer.

U.S. Pat. No. 5,272,640—Wu

An automatic mail-processing device with full functions, which can be operated by only one postal clerk, and wherein by means of a microprocessor, all kinds of delivery types and additional service types such as registered special, insured, attested and express types of various individual letters or bulk mailings are included and functions of automatically weighing, postage calculation, charging, postage stamping, postage receipt printing, register receipt printing, and regular daily, weekly or monthly income list printing are performed.

The submission of the above list of documents is not intended as an admission that any such document constitutes prior art against the claims of the present application. Applicant does not waive any right to take any action that would be appropriate to antedate or otherwise remove any listed document as a competent reference against the claims of the present application.

SUMMARY

In general terms, the invention disclosed hereby includes a postage metering device and a system for device utilization having an embedded program, a portion of which is permanent; and, another portion, configurable. The configurable portion includes, as will be seen by the description which follows, both management and user programs. Within the management program is a postage database containing postal service costs for all types of parcel delivery systems. The device is usable to print a postal postmark on all postal and private courier parcels and envelopes. The system utilizes proprietary software placed on an integrated circuit chip (IC) to frank postage for any given country; purchase private courier postage; compare rates of various courier services; optimize postage rates; purchase telephonically postage for the necessary service; track customer usage; and, print the postmark of the corresponding service and amount directly on the parcel envelope or specially designed labels.

The apparatus and system therefor can be used in any country where the postal service subscribes to a clearing house managing system. The system provides country specific postal and courier rates. Corresponding to the cross-functionality thereof, currency conversions as of the date and time clearing house postage purchases are provided. The system charges users as of the date of purchase and thereby locks in rates and postage purchases. During operation, purchases are made directly from specific vendors (assuming they subscribe to the system) or indirectly from the clearing house used by the vendors.

The postage metering system of this invention operates in either a debit or credit mode. In the debit mode, postage is pre-paid by the user through a telephonic clearing house arrangement or is pre-paid directly to a vendor. In the credit mode, the credit card information is entered into the unit and postage from the telephonic clearing house or from the vendor is purchase thereby. Each unit carries a serial number registered to a user. The number is transmitted on all postmarks and facilitates communication with the clearing house or vendor. If the unit is lost or stolen, the user contacts the clearing house and has the unit permanently disabled. The device is adapted for use within an office network or personal computing system, and through the use of the master purchase feature, postage from the clearing house or specific vendors can be downloaded to the user.

Optionally, an electronic scale is linked to postage metering device. Personal or commerical messages and graphics are available for printing with the postal mark. Within the system, graphical information for use in printing can be downloaded from clearing house and/or vendor databases. For personal use, a miniaturized postal franking machine utilizing the postage metering system, described above is available. The unit is designed for portability and incorporates the cost saving features of the above system. The components of the unit include an impact printer; liquid crystal display (LCD); and, telephone connection with an RJ11/12 jack, key pad, speaker and supplementary power connector. The device operates at low voltage on either batteries or an a-c adapter. In the rapid print mode, the unit prints a common postage postmark.

Optionally and to protect against illegal or unknown usage, the device has a password protection mechanism. When the device is applied as a peripheral printer/postmarking device for connection to a personal computer or office network computing system, the postage metering software system is loaded onto the host computer and, except for portability, offers the same features as above.

OBJECT AND FEATURES OF THE INVENTION

It is an object of the present invention to provide a cost management system for mail and parcel delivery.

It is a further object of the present invention to provide such a system in a form connectable to a variety of hardware platforms such as mainframe computers; workgroup area networks; local area networks; personal computers; self-contained units, including postal meters; and, portable devices.

It is another object of the present invention to provide access to multiple postal service carriers, including domestic and international carriers.

It is yet another object of the present invention to provide a method of cost optimization based on the system rate information and desired service classification.

It is a feature of the present invention that the system is operable in a credit or a debit mode.

It is another feature of the present invention to have a graphics capability supporting the various carrier requisites.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENT

Figure 1:
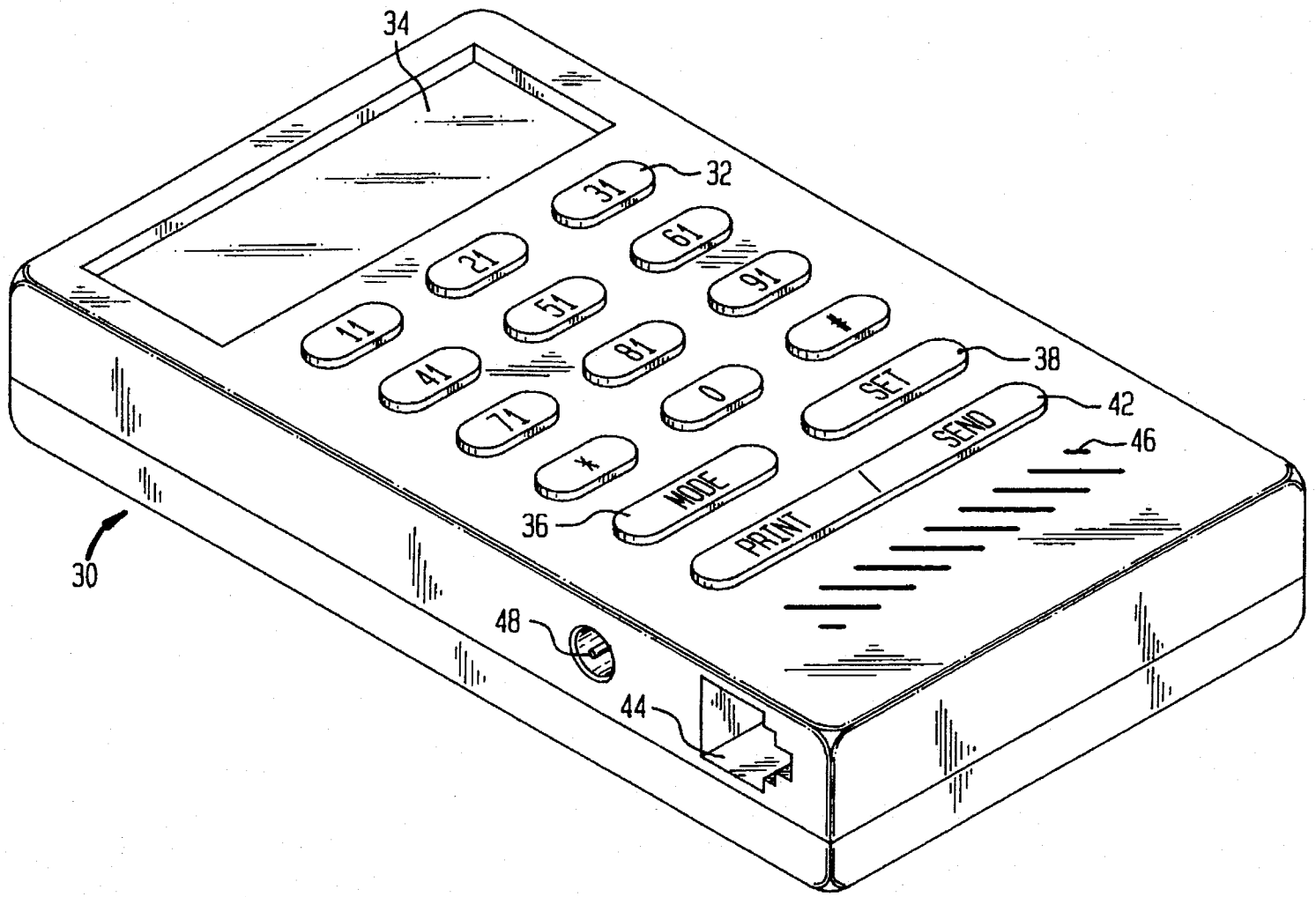
FIG. 1 is a perspective view of the postage metering device of the present invention, showing the data entry facility, the data display window, and provisions for interconnection with both computer and communications networks.
Figure 2:
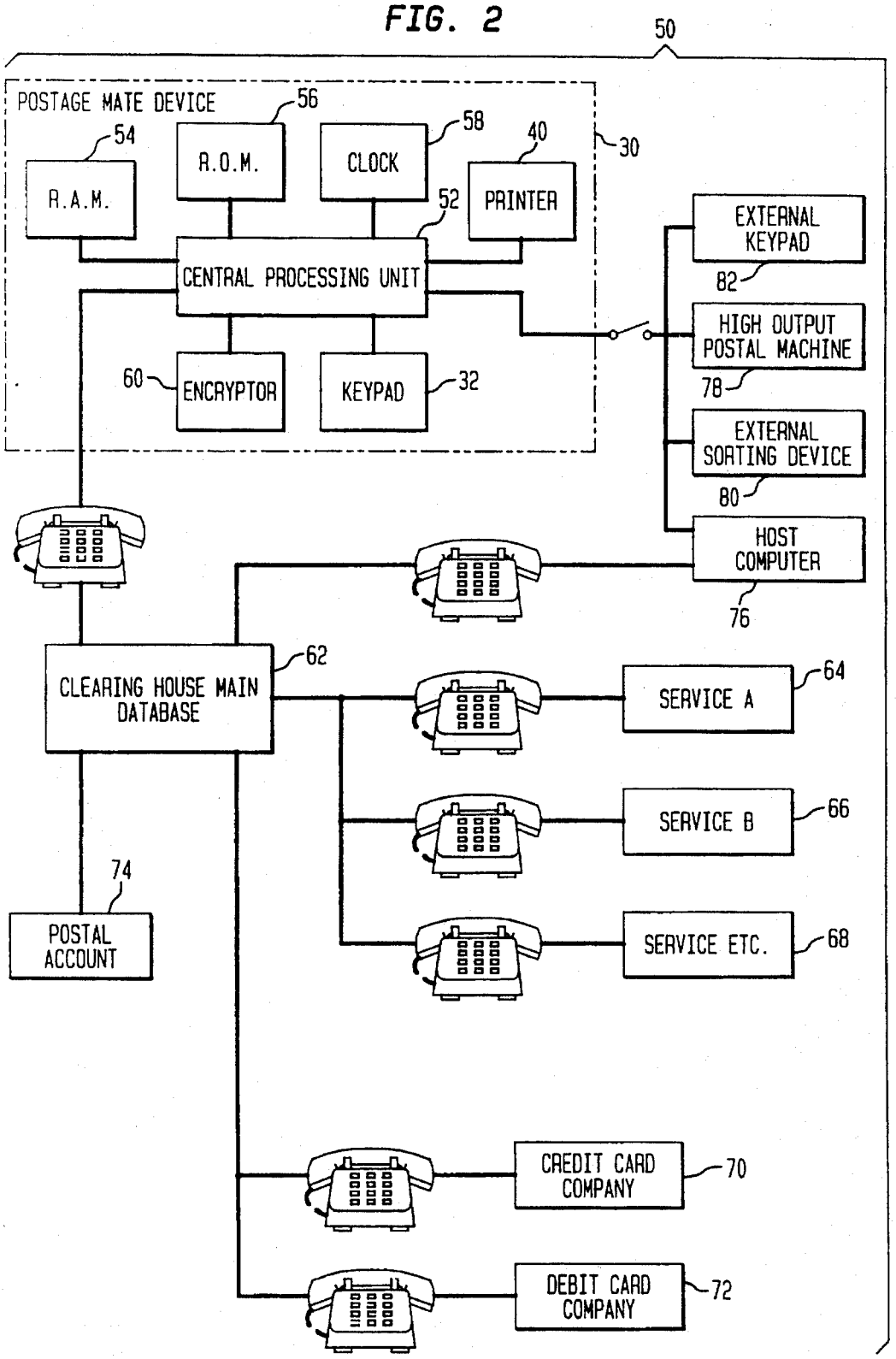
FIG. 2 is a system block diagram of the postal cost management system of the invention shown in FIG. 1.

A postage metering device of this invention is shown in FIG. 1 and is referred to generally by the numeral 30, which device together with the proprietary software described in detail hereinbelow provides an innovative postal cost management system for all types of letter and parcel delivery. In the following general description an occasional reference is made to the system block diagram, FIG. 2. The postage metering device 30 is structured with the proprietary software thereof placed on and embedded within an integrated circuit (IC) chip (not shown). A keypad 32 is provided for data input and an LCD (liquid crystal display) 34 is provided for data display. A MODE switch and a SET switch 36 and 38, respectively, are arranged to provide for changing and selection of the various modes, see infra. Once the amount and type of postage is determined by the comparative and optimization functions of the software, the PRINT mode is entered and an impact printer 40, FIG. 2, is operated by depressing a PRINT/SEND switch 42, FIG. 1. In other modes, the depressing of the PRINT/SEND switch 42 toggles data for transmission thereof over a telephone connection through an RJ11/12 jack 44. Data transmission and communications is also enhanced by an audio channel utilizing a speaker 46. An adapter connector 48 connects the device 30, which operates at low voltage d-c or batteries, to power through an a-c adapter.

As will be seen from the detailed description, the system through the embedded software enables the printing of postmarks on all postal and private courier parcels and envelopes. The system is designed so that upon printing each postmark a bar code is also provided. The bar code impression has numerous fields which includes, by way of example, the user identification number, the amount purchased, the clearing house and user account numbers, the device serial number, the specific carrier or the information that the postage is non-carrier specific, and the date of the postmark. Before discussing the balance of the system block diagram an overview of the embedded software is presented to provide a framework for the reader hereof. The system has incorporated therewithin programming functions for setting the default parameters thereof. See Table I, Table of Overall Default Parameters. The settings are, in general terms, used to select the country, the graphics for envelope message printing, the vendor service to be employed, the class of mail including weights and pricing, the general ledger account codes, the purchase order account codes, the user specific information, the credit and debit card data, and the service provider account data; and, to establish computer protocols, the password protection, and the time and date. This function sets the default postage and service selection for the print mode.

The purchase of specified amounts of postage from specific vendors occurs in the Buy Postage mode. The functions therewithin require that the device 30 be connected and/or interface with a service or host computer for the purchase transaction. Upon selecting the service desired and entering the amount of postage to be purchased, a debit or credit card account is charged for the transaction based on the defaults established in the programming

TABLE I

| TABLE OF OVERALL DEFAULT PARAMETERS |
|---|
| User Defaults |
| Unique unit identification code: encoded into the unit may not be changed by user. This feature provides security and, in the event of theft, conforms to various vendor requirements. |
| Country |
| Graphic: Message and graphics to be downloaded or entered by user for printing with postage indicia |
| Vendor service selection |
| e.g. US Postal Service |
| Class of mail |
| Postage by weight |
| Postage by price |
| Purchase Account Code (PAC) |
| Account Code (AC) |
| User: |
| Name |
| Street Address |
| City, state, zip |
| Tel. Number |
| Postage Account: |
| Account Number |
| Method of Payment (MOP) |
| Debit Account (PAC) |
| Account Number |
| Cash (PAC) |
| Credit Card (PAC) |
| Credit Card Type |
| Credit Card Number |
| Country |
| Multiple Countries (Y/N) |
| (If Yes) Enter first Country Code (CC) |
| Current Country |
| Computer Interface |
| Type of computer |
| Password Protection (Y/N) |
| If Yes, Enter Password |
| Account Code (AC) (Y/N) |
| If Yes, enter Account Code (AC) |
| Date/time |

function. These defaults are set forth in Table II, Table of Defaults in the Buy Postage Mode.

The calculation of postage rates for parcels is provided by the postage calculator mode. Upon entering parcel specific information and selections relative to the purchase of postage, postage is obtained and a stamp for the parcel is then printed. Operating in this mode the postage used is deducted from the postage purchased. The device maintains a current balance of postage available from each specific vendor from which postage has been purchased. Besides the carrier specific postage just described, through the use of the device one may buy in bulk non-specific postage from a clearing house for preselected carriers. Upon use, non-specific postage is then deducted from the bulk account. The allocation of bulk postage among the carriers is verifiable by two mutually non-exclusive pathways, namely, postal user reporting or postal carrier billing. In the postal user reporting method, a periodic data entry of the actual amount of the postage and of the

TABLE II

| TABLE OF DEFAULTS IN THE BUY POSTAGE MODE |
|---|
| Select type to buy |
| US Mail |
| Amount |
| Press set to buy |
| Federal Express |
| Amount |
| Press set to buy |
| United Parcel Service |
| Amount |
| Press set to buy |
| Foreign Mail Service |
| Amount |
| Press set to buy |
| Other available mail service |
| Amount |
| Press set to buy |

allocation thereof among the carriers is provided through an interface with the clearing house. The burden of third-party verification then resides with the carrier. In the postal carrier billing method, upon the postal carrier scanning the postmark and finding nonspecific postage, the postal carrier bills the clearing house directly and provides the clearing house with the user data. The burden of third-party verification then resides with the user.

Without purchasing postage, this function is utilizable to perform rate comparisons by service. The defaults in the postage calculator mode are set forth in Table III, Table of Defaults in the Postage Calculator Mode.

The rapid purchasing of postage and printing of stamps from selected vendor services is provided by the Postage by Service mode. The postage used is deducted on a vendor-by-vendor basis

TABLE III

| TABLE OF DEFAULTS IN THE POSTAGE CALCULATOR MODE |
|---|
| Parcel specifics |
| Type of parcel |
| Letter |
| 1 lb pack |
| Size of parcel |
| Length |
| Width |
| Depth |
| Weight of parcel |
| Sender Zip Code |
| Destination Zip Code |
| Type of service, IF APPLICABLE |
| Regular |
| Overnight |
| Options, IF APPLICABLE |
| Insurance (Y/N) |
| Amount |
| Certified (Y/N) |
| Return receipt requested (Y/N) |
| Registered |
| Buy Postage |
| Print Stamp |
| Account Code |

from the postage purchased. The program maintains a current balance of postage available from each specific vendor from which postage has been purchased. The defaults for this mode are presented in Table IV, Table of Defaults in the Postage by Service Mode.

The Communications mode connects the user to a host computer and/or vendor service. This function utilizes the above-delineated defaults established in the programming function for interface and protocols to connect to external machines. After connection, the functions of purchasing postage, downloading vendor service data, or downloading previously purchased postage from a host computer are available. Depending on the type of connection required, connection is through a direct cable or telephone.

The Off/Lock mode provides for system security. The security codes will be established in the programming function. This function also confirms power on/off status of the device.

The postal cost management system is now further described with reference to FIG. 2 wherein the system is referred to by the numeral 50. The postage metering device 30, see supra, which operates on a variety of host computer platforms, is constructed to provide a portable franking device featuring a postal

TABLE IV

TABLE OF DEFAULTS IN THE POSTAGE BY SERVICE MODE

| |
|---|
| Select Service |
| US Mail |
| Class of mail |
| Postage by weight |
| Postage by amount |
| Federal Express |
| United Parcel |
| Buy Postage |
| Print Stamp |
| Account Code |

printout with cost optimization. The device 30 has a central processing unit (CPU) 52 which is served by and serves a random access memory (RAM) 54 and a read-only memory (ROM) 56. These memory units 54 and 56 are constructed to store the requisite programs and databases for the functions outlined above and described in detail below. To further enable the transactions, the metering device 30 further includes a clock 58 for inter alia stamping time and date on the postal indicia, a keypad 32 for the input of data, and an impact printer 40 for output purposes. An encryptor 60 is also provided to secure the system against unauthorized usage. A communications interface enables the purchasing postage in bulk or on a limited basis postage through a clearing house 62 which, in turn, interfaces with various postal/carrier services 64, 66, and 68; with credit services 70; with debit card vendors 72 for credit services; and, with a national postal service 74. Optionally, postage is purchased through a direct service provider account i.e. Federal Express, UPS, etc. Any number of direct service providers may interface with the system. The postage metering device may be used as a stand alone device with direct connection to the clearing house 62 or be connected through a host network or mainframe host computer 76. In the latter case, the system is broadened to include various output devices to print indicia, such as high output postal machines or stations 78, and external sorting devices 80. These devices are controllable by the central processing unit 52 and provide additional capacity to the overall system. Other peripherals, such as an external keypad 82 or an electronic scale (not shown), are also applicable. The clearinghouse 62 interface provides downloading of current rate table information for optimization and postage calculations. The postage metering device 30 is utilizable on a stand alone basis with any of the above-mentioned peripheral devices. The host computer or host network 76 is utilizable as a central purchaser of postage from a variety of sources, which postage is then distributable throughout a network. The system 50 thereby establishes a program of postal cost management, not only through rate comparisons and postage optimization, but also through bulk purchasing and integration with the system of a variety of networked units and peripheral devices and of a variety of service providers—both credit and debit service providers. The use of a host system provides a means to account for postage usage within an organization. The optimization features of the system provide cost benefits by allowing the user to make informed purchase decisions from postal/parcel carriers. While the postage cost management system provides complete information, the user is the ultimate decision maker as discretion is retained through manual overrides on the types and levels of services to be utilized.

The above describes a rate comparator program in functional cooperation with the management program which, in turn, provides optimization of services.

Figure 3:
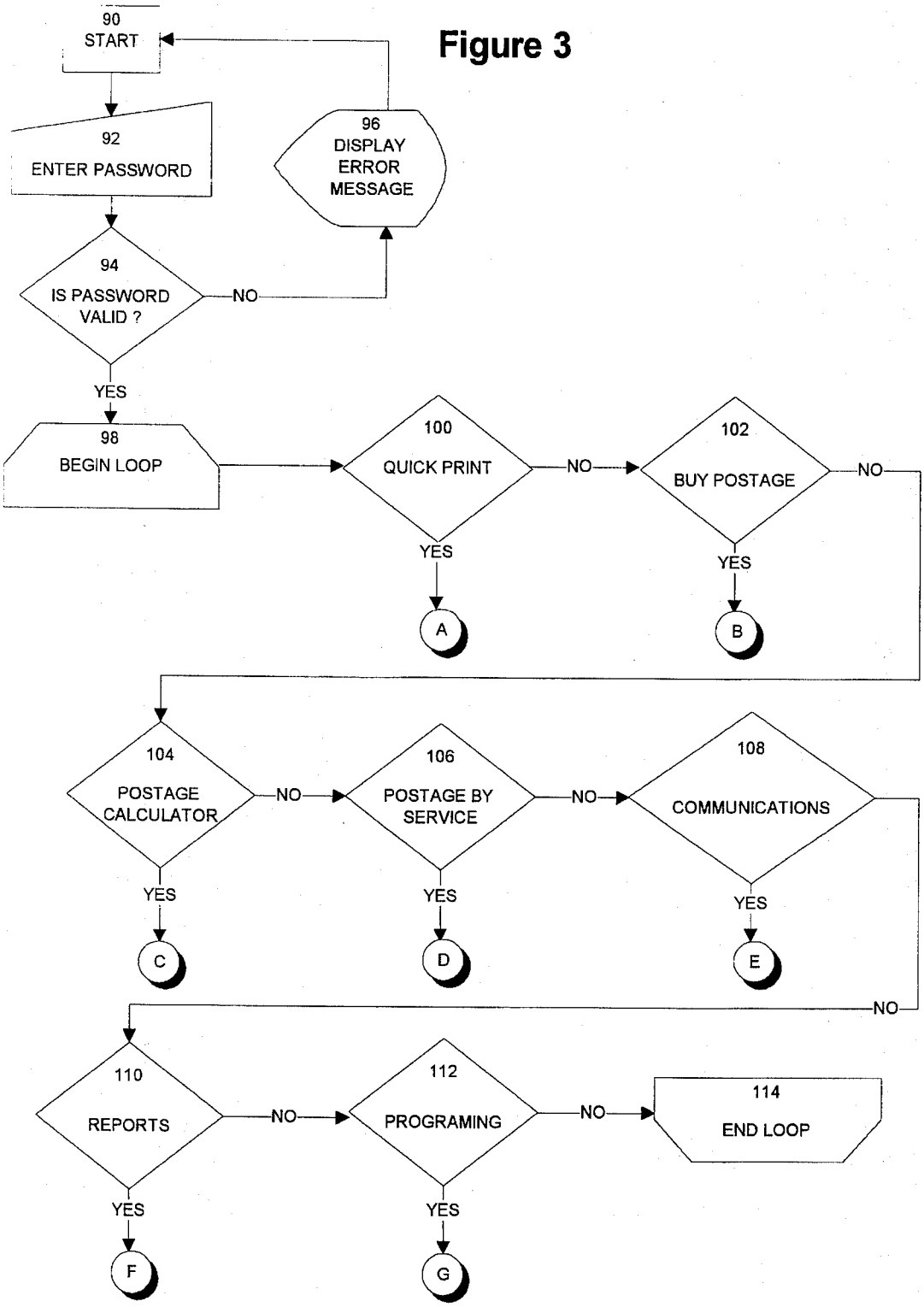
FIG. 3 is a flow chart showing the principal functional elements of the system shown invention in FIG. 2 and the main menu formed therefrom.
Figure 10:
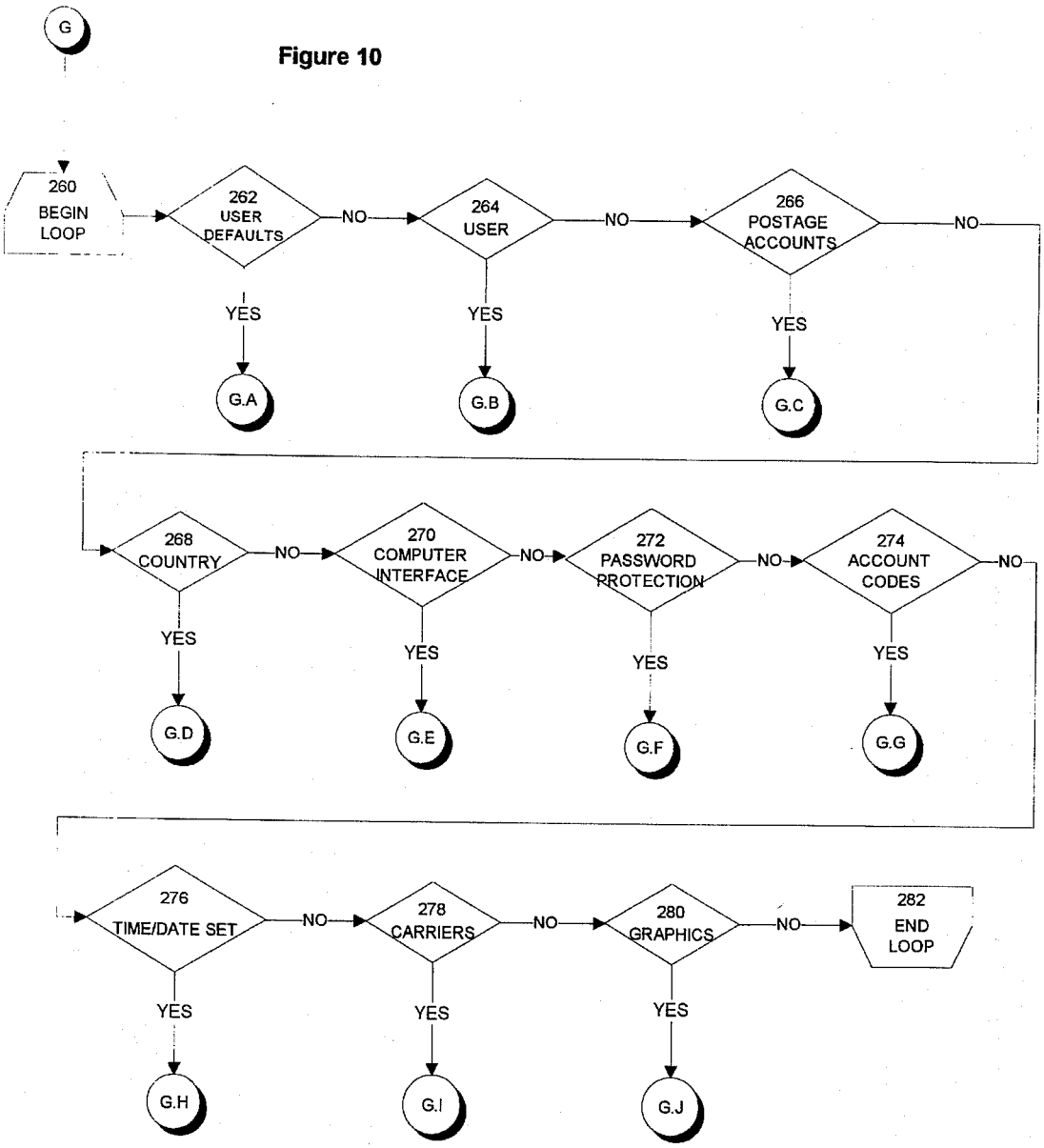
FIG. 10 is a flow chart showing the PROGRAMING elements of the system shown in FIG. 3 and the submenu formed therefrom.
Figure 11:
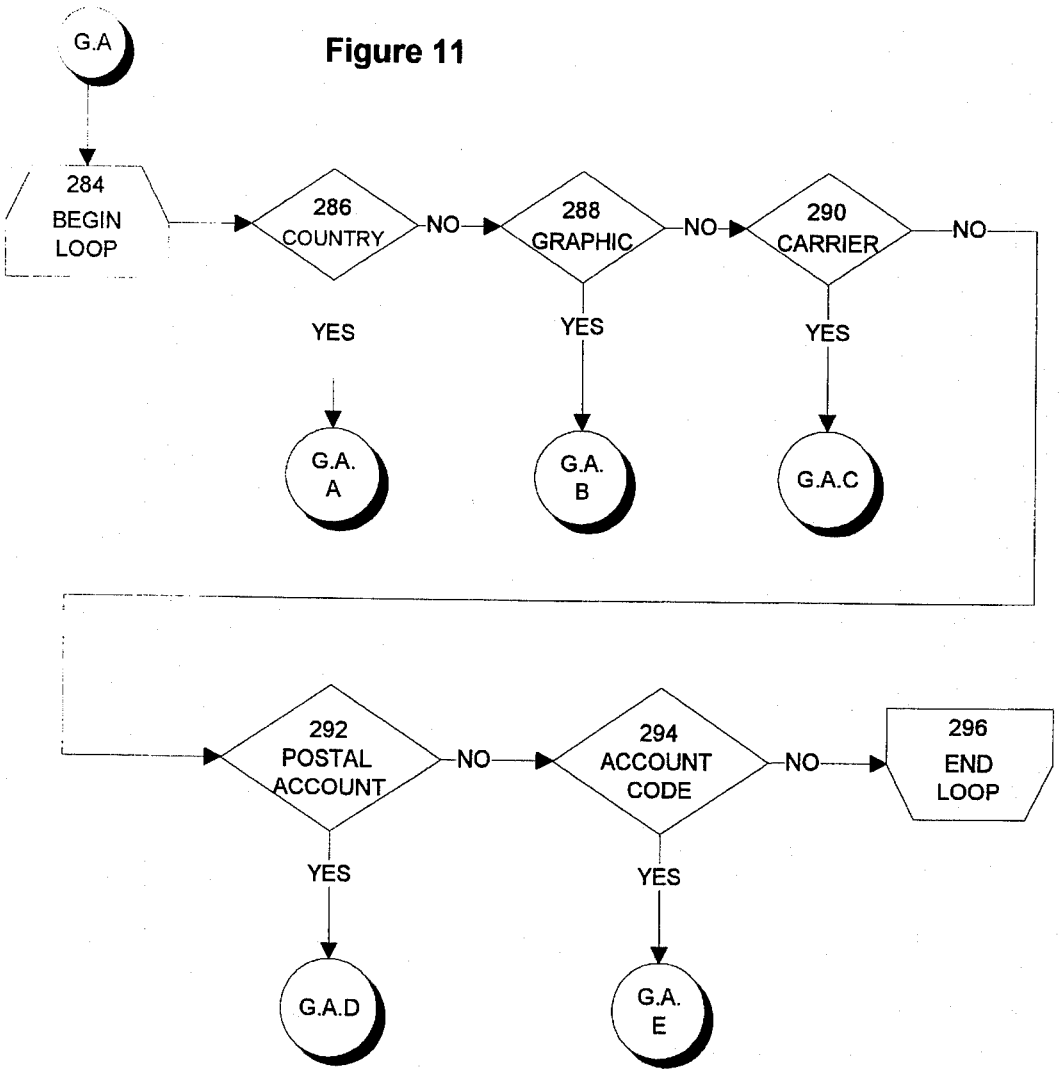
FIG. 11 is a flow chart showing the USER DEFAULTS elements of the system shown in FIG. 10 and the submenu formed therefrom.

FIGS. 3 through 25 is a flow chart of the programs employed herein. It is noted that the flow chart convention of labeling common terminals within the flow chart by the same capital letter within a circle is followed here. Referring now to FIGS. 3 through 25, the Main Menu functions are shown in FIG. 3; details of the Main Menu functions are shown in FIGS. 4 through 10; the Programing Submenu functions are shown in FIG. 10; the User Defaults Submenu functions are shown in FIG. 11; details of the Programing Submenu functions are shown in FIGS. 11 through 20; and, details of the User Defaults Submenu functions are shown in FIGS. 21 through 25. Typically, in following the flow chart, infra, when a particular option is not selected the program proceeds to the next functional block. The logic that follows reflects user inputs and processes. The logical pathway commences with power being supplied to the CPU 52 at START block 90. Upon power being supplied to the CPU 52, the user is immediately prompted to supply a password at ENTER PASSWORD block 92. Thereupon a password or, in the event password usage has not been initiated, a null variable is entered. Except when a null variable is accepted, upon an invalid password being presented at IS PASSWORD VALID? block 94, an error message is displayed at DISPLAY ERROR MESSAGE block 96. After an error message is displayed, the user is returned to START block 90. Upon the validation and acceptance of the password, the user then progresses to the data entry loop at BEGIN LOOP block 98. By either using a arrow key or other designated key to scroll through the various prompts, the user commences the main menu listing the system function categories. The first prompt is the QUICK PRINT option 100. If this option is selected, the program proceeds to FIG. 4 wherein the QUICK PRINT function is shown and and continues from thence through the loop. The second prompt is the BUY POSTAGE option 102. If this option is selected, the program proceeds to FIG. 5 wherein the BUY POSTAGE option is shown. The next menu item is the POSTAGE CALCULATOR function 104 and if this option is selected, the program description continues at FIG. 6. The next menu item is the POSTAGE BY SERVICE function 106. If this option is selected, the program proceeds to FIG. 7 wherein the POSTAGE BY SERVICE function is shown. The next menu item is the COMMUNICATIONS function 108. If this option is selected, the program proceeds to FIG. 8 wherein the COMMUNICATIONS function is shown. The next prompt is the REPORTS option 110. If this option is selected, the program proceeds to FIG. 9 wherein the REPORTS option is shown. The next menu item is the PROGRAMING function 112. If this option is selected, the program proceeds to FIG. 10 wherein the PROGRAMING function is shown. In the system program, the main menu prompts ends at the END LOOP block 114 whereupon the system returns to the BEGIN LOOP block 98 so that one may again scroll through the functions.

Figure 4:
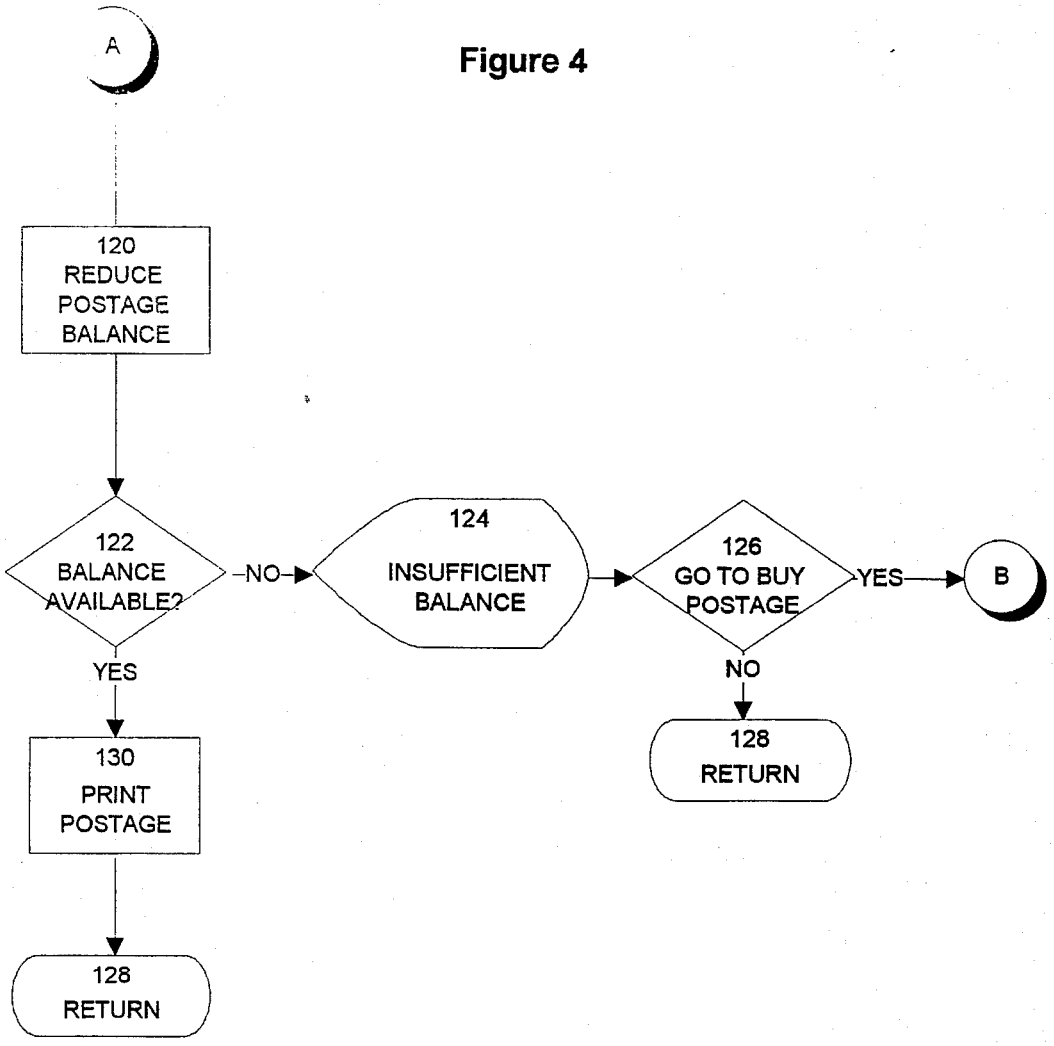
FIG. 4 is a flow chart showing details of the QUICK PRINT function of FIG. 3.

Referring now to FIG. 4, a submenu for the QUICK PRINT option 100 is shown, which submenu utilizes the default information provided in the PROGRAMING function 112. Upon use of this function, the postage balance available is immediately initiated at REDUCE POSTAGE BALANCE block 120. Based on this reduction, the CPU 52 determines at BALANCE AVAILABLE? block 122 whether or not an adequate balance is available. In the event an insufficient balance is available, an INSUFFICIENT BALANCE message 124 is displayed followed by a GO TO BUY POSTAGE request 126 to determine whether or not the user wishes to buy additional postage. If an election not to purchase postage is made, the program returns to the main menu, FIG. 3, by RETURN block 128. If an election to purchase postage is made, the program initiates the BUY POSTAGE option 102 as shown on FIG. 5. In the event postage is available, the postage is printed at PRINT POSTAGE block 130. After the postal indicia is printed, the program returns to the main menu, FIG. 3, by RETURN block 128.

Figure 5:
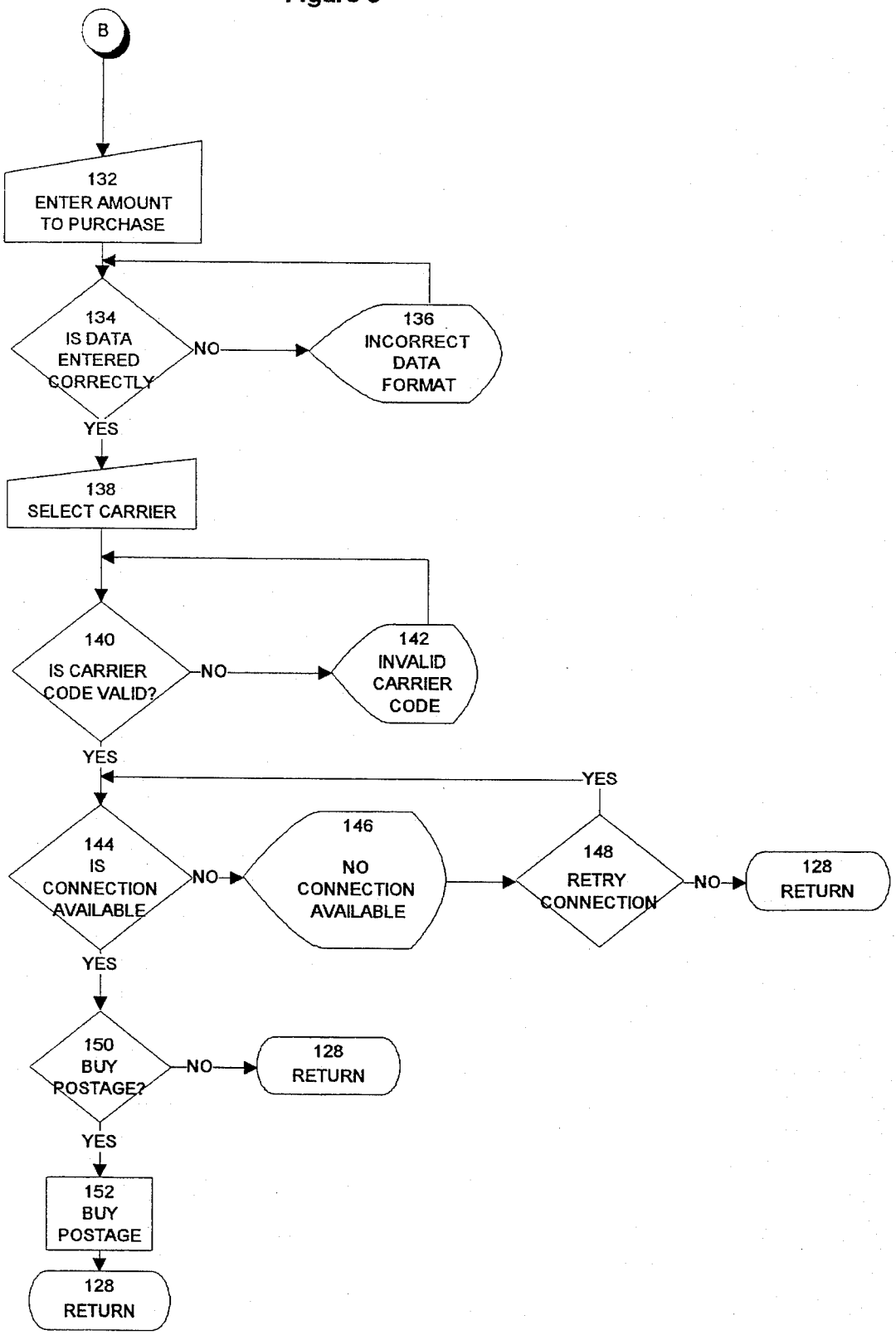
FIG. 5 is a flow chart showing details of the BUY POSTAGE function of FIG. 3.

Referring now to FIG. 5, the flow diagram for the BUY POSTAGE function 102 indicates how the system generates a series of prompts which require specific inputs by way of response. These inputs commence with a request for the amount of postage to be purchased at an ENTER AMOUNT TO PURCHASE block 132. The CPU 52 then determines whether or not the data entered is entered in correct format at an IS DATA CORRECTLY ENTERED block 134. In the event data is in incorrect form, an INCORRECT DATA FORMAT message 136 and the user again is prompted by an ENTER AMOUNT TO PURCHASE block 132. In the event a null amount is entered, the user is returned to FIG. 3 the main menu. Once data is correctly entered the the next prompt is a SELECT CARRIER option 138. The CPU 52 then processes the carrier code and validates the code at IS CARRIER CODE VALID? block 140. If the carrier code is invalid, an VALID CARRIER CODE message 142 is displayed and the user is returned to the SELECT CARRIER input 138. When a null carrier is entered, the program returns to FIG. 3 main menu. Upon the CPU 52 validating the carrier code, the CPU 52 determines whether or not an external interface connection exists or may be established at an IS CONNECTION AVAILABLE? block 144. If no connection Is or may be established, a NO CONNECTION AVAILABLE error message 146 is displayed. The program then provides a RETRY CONNECTION prompt 148. Upon an election not to retry the connection, the program returns to FIG. 3 at RETURN block 128. Upon an election to retry and RETRY CONNECTION function 148 establishes a connection, the program returns to block 144. Upon the connection being established, the program provides a BUY POSTAGE? prompt 150 to determine whether or not the user wishes to buy postage. If an election is made not to buy postage, the program returns to FIG. 3 at RETURN block 128. In the event the user elects to buy postage, the CPU 52 processes the BUY POSTAGE function 152 and buys postage from an external source. Upon completion of purchase of postage, CPU 52 disconnects from the external source and the program returns to FIG. 3 at RETURN block 128.

Figure 6:
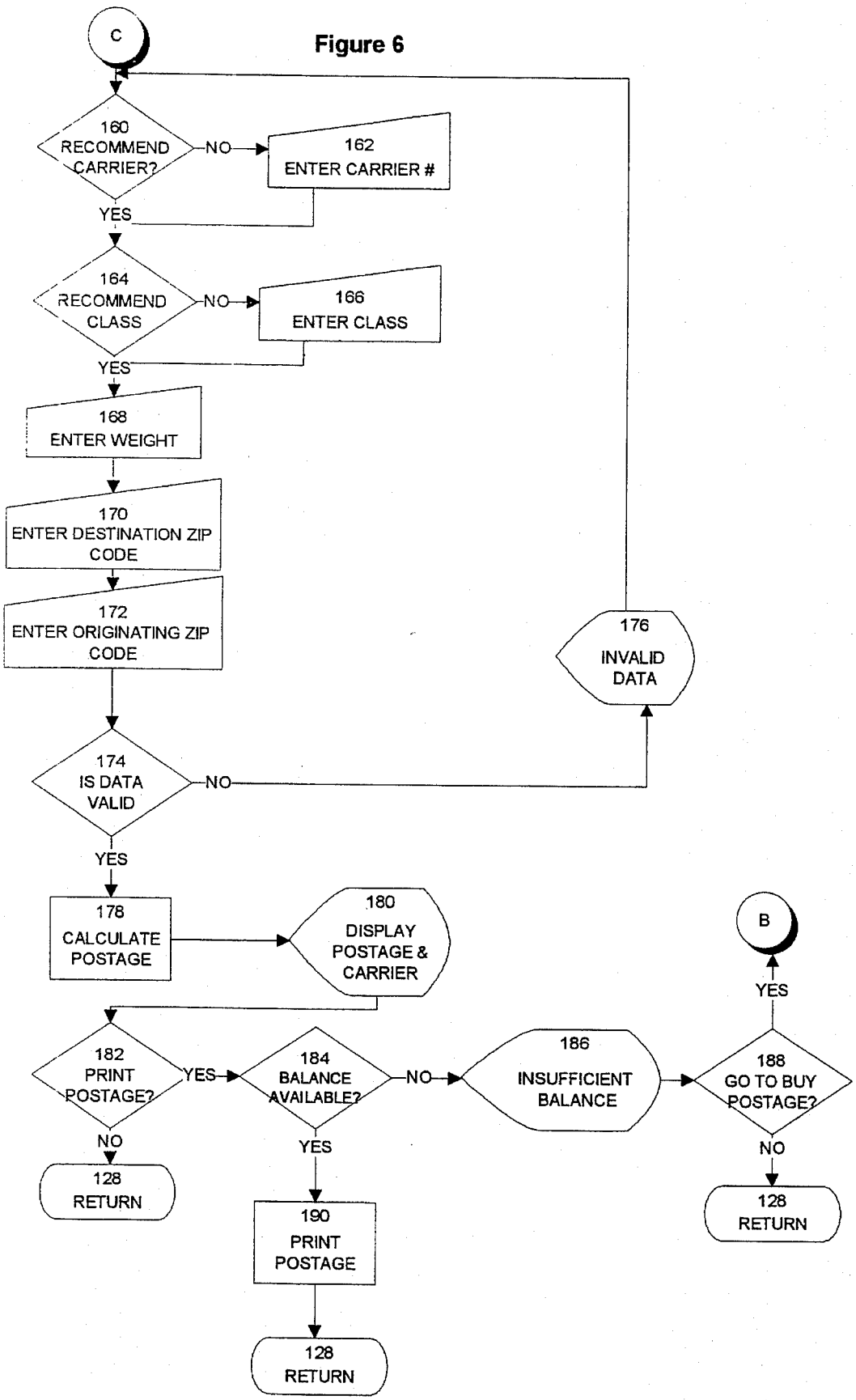
FIG. 6 is a flow chart showing details of the POSTAGE CALCULATOR function of FIG. 3.

The POSTAGE CALCULATOR function 104 is next shown in FIG. 6. Here, the program initially prompts the user to select a carrier of choice at RECOMMEND CARRIER block 160. Upon a user response of NO or overriding the program-provided choice, the program provides a data request ENTER CARRIER # prompt 162. Upon a user response of YES by the entry of a null character, the CPU 52 determines the carrier based on the optimization algorithm employed. The program then similarly prompts a choice of postal class at RECOMMEND CLASS block 164. Upon being prompted to select a class of postage, the user may elect a NO response overriding the program-provided choice and thereupon select a class and enter the class at ENTER CLASS block 166. Alternatively, the user may elect a YES response, and have the CPU 52 determine a class for the postage. After the postal class is selected, the system now provides a series of prompts for the data entry from the user, namely and in sequence, to enter weight at ENTER WEIGHT block 168, then to enter the destination zip code at ENTER DESTINATION ZIP CODE block 170, and then to enter the origination zip code at ENTER ORIGINATION ZIP CODE block 172. While the data is requested in a specific sequence, the particular order in which the data is accumulated is not material. The aforementioned data is then validated by the CPU 52 by a query at IS DATA VALID block 174. In the event the data cannot be validated or is invalid, an INVALID DATA error message 176 is displayed. If an INVALID DATA message appears, the program returns to the RECOMMEND CARRIER block 160. In the event the data is validated, the CPU 52 calculates the postage at CALCULATE POSTAGE block 178 and displays the postage and carrier information at DISPLAY POSTAGE & CARRIER display 180. The program then provides a PRINT POSTAGE ? prompt 182 to select either print postage or return to main menu FIG. 3 through RETURN block 128. If the user elects to print postage, the CPU 52, in a manner similar to the QUICK PRINT function of FIG. 4, above, validates an available balance. As before, the CPU 52 determines at BALANCE AVAILABLE? (PC) block 184 whether or not an adequate balance is available. In the event an insufficient balance is available, an INSUFFICIENT BALANCE (PC) message 186 is displayed followed by a GO TO BUY POSTAGE (PC) request 188 to determine whether or not the user wishes to buy additional postage. If an election not to purchase postage is made, the program returns to the main menu, FIG. 3, by RETURN block 128. If an election to purchase postage is made, the program initiates the BUY POSTAGE option 102 as shown on FIG. 5. In the event postage is available, the postage is printed at PRINT POSTAGE (PC) block 190. After the postal indicia is printed, the program returns to the main menu, FIG. 3, by RETURN block 128.

Figure 7:
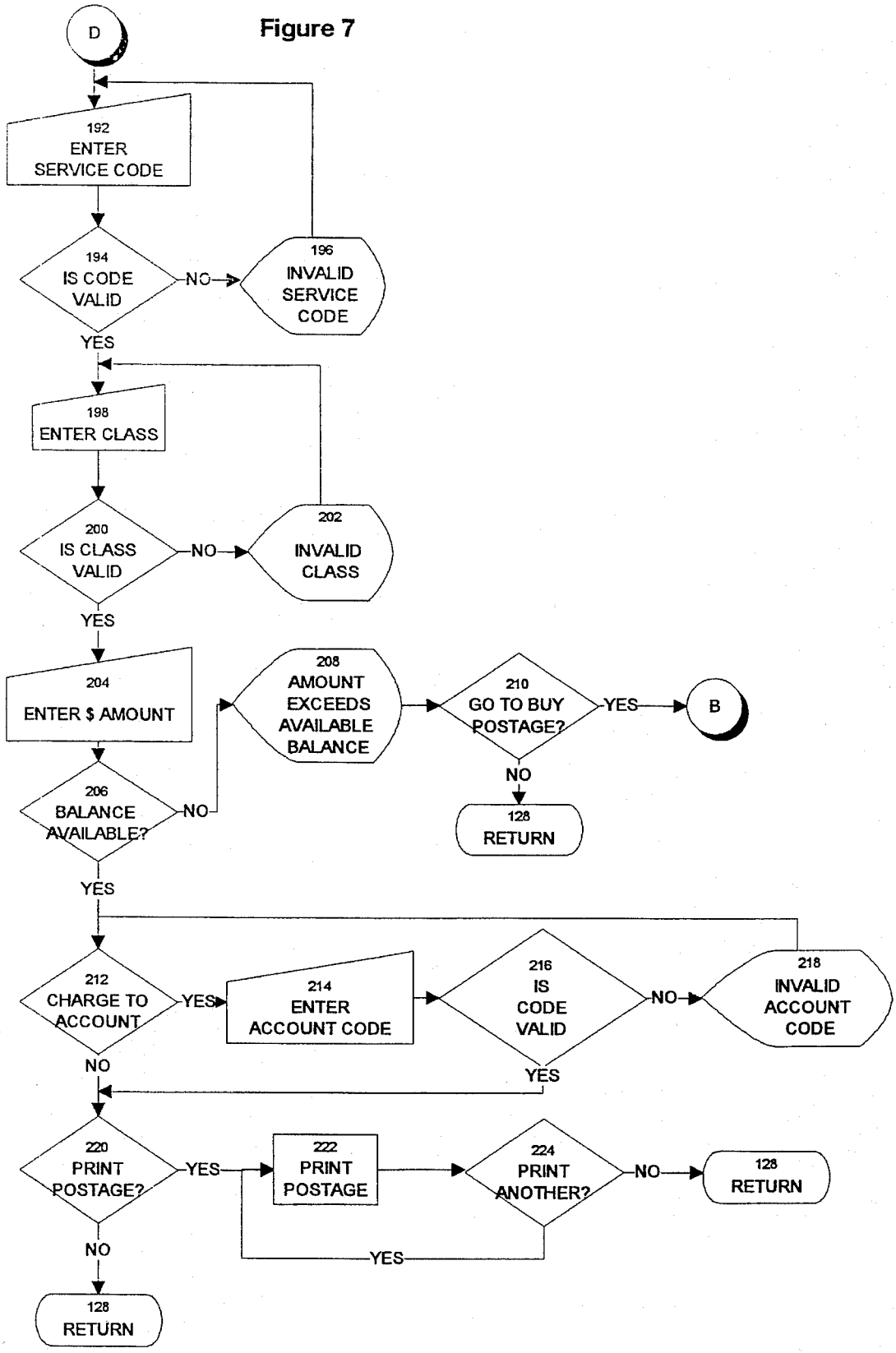
FIG. 7 is a flow chart showing details of the POSTAGE BY SERVICE function of FIG. 3.

Now referring to FIG. 7, the POSTAGE BY SERVICE (PS) function 106 is shown therein. The system provides an ENTER SERVICE CODE prompt 192. Upon entering the service code number, the service code is validated at IS CODE VALID block 194. If the service code number is invalid, an INVALID SERVICE CODE error message 196 is displayed and the user is again provided with the ENTER SERVICE CODE prompt 192. If a null character is entered the user is returned to FIG. 3. If the service code number is valid, the system provides the user with an ENTER CLASS (PS) prompt 198. Once the classification is entered, the validity thereof is checked by the CPU 52 through a IS CLASS VALID system query 200. If an invalid number is entered an INVALID CLASS error message 202 is displayed and the user is again prompted with an ENTER CLASS (PS)

prompt 198. If the postal classification number is valid, as determined by the CPU 52, the system is then provides an ENTER $ AMOUNT prompt 204. The CPU 52 then determines at BALANCE AVAILABLE? (PS) block 206 whether or not a sufficient balance is available. If an insufficient balance is available an AMOUNT EXCEEDS AVAILABLE BALANCE error message 208 is displayed. The system then provides a GO BUY POSTAGE? (PS) query 210. A positive response returns the user to the BUY POSTAGE function 102; and a negative response, to the main menu, FIG. 3, by RETURN block 128. If the CPU 52 determines that there is a sufficient balance available, the system now determines at CHARGE TO ACCOUNT block 212 whether or not the transaction should be charged to an account. Upon a positive response, the system provides an ENTER ACCOUNT CODE prompt 214, and the CPU 52 in response to an IS CODE VALID query 216 then validates the account code. If the account code is not valid, an INVALID ACCOUNT CODE error message 218 is displayed and the user is returned to the CHARGE TO ACCOUNT block 212. If the account code is valid—a YES response is elicited, and the user reaches the PRINT POSTAGE? prompt 220. Upon a negative response to the request to enter the account to be charged, the system overrides the account charge system. Prior to completing the override or upon account code validation, a system PRINT POSTAGE? prompt 220 determines whether or not to print postage. If the user chooses not to print postage, the system returns to the main menu by way of RETURN block 128 to FIG. 3. If the user chooses to print postage, the postage indicia is printed at the PRINT POSTAGE function 222. The system then provides a PRINT ANOTHER? prompt 224 with a print again query. If, as in the case of repetitive mailings, the user chooses to print the same postage and responds in the affirmative, the system keeps returning to PRINT POSTAGE function 222, until the response to PRINT ANOTHER? is NO, whereupon the system returns through RETURN block 128 to main menu.

Figure 8:
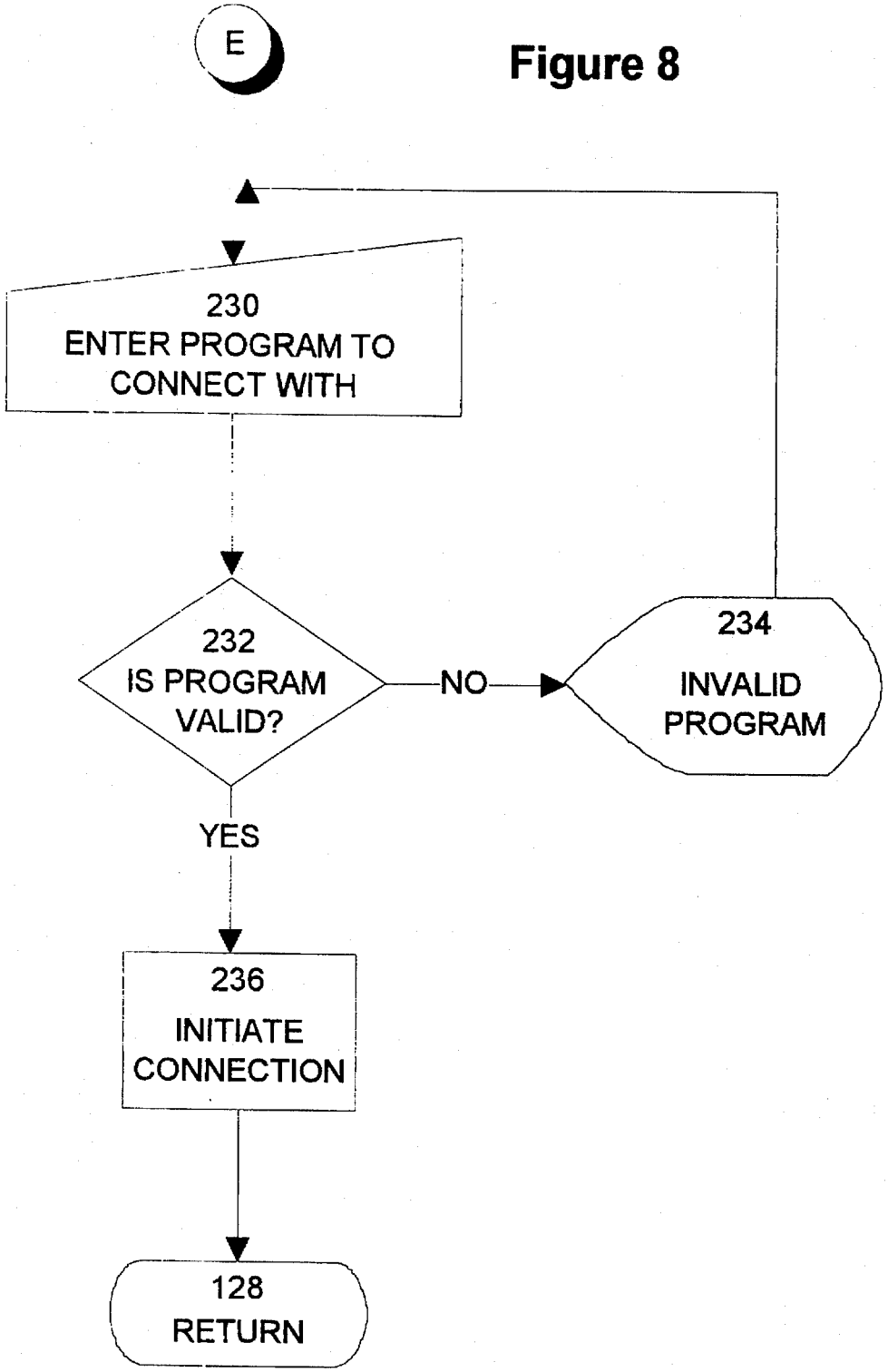
FIG. 8 is a flow chart showing details of the COMMUNICATIONS function of FIG. 3.

Now referring to FIG. 8, the COMMUNICATIONS function 108 is shown. The user begins communications connect at ENTER PROGRAM TO CONNECT WITH block 230 and enters the program name or code. Upon a system query at IS PROGRAMVALID block 232, the CPU 52 then validates the program name or code. If the system determines the program name or code is invalid, an INVALID PROGRAM error message 234 is displayed. The user is returned to re-enter the communication connect at ENTER PROGRAM TO CONNECT WITH block 230. If a program is determined to be valid by CPU 52, the system provides an INITIATE CONNECTION function 236. If a null character is entered, the user is returned to main menu, FIG. 3, through RETURN block 128.

Figure 9:
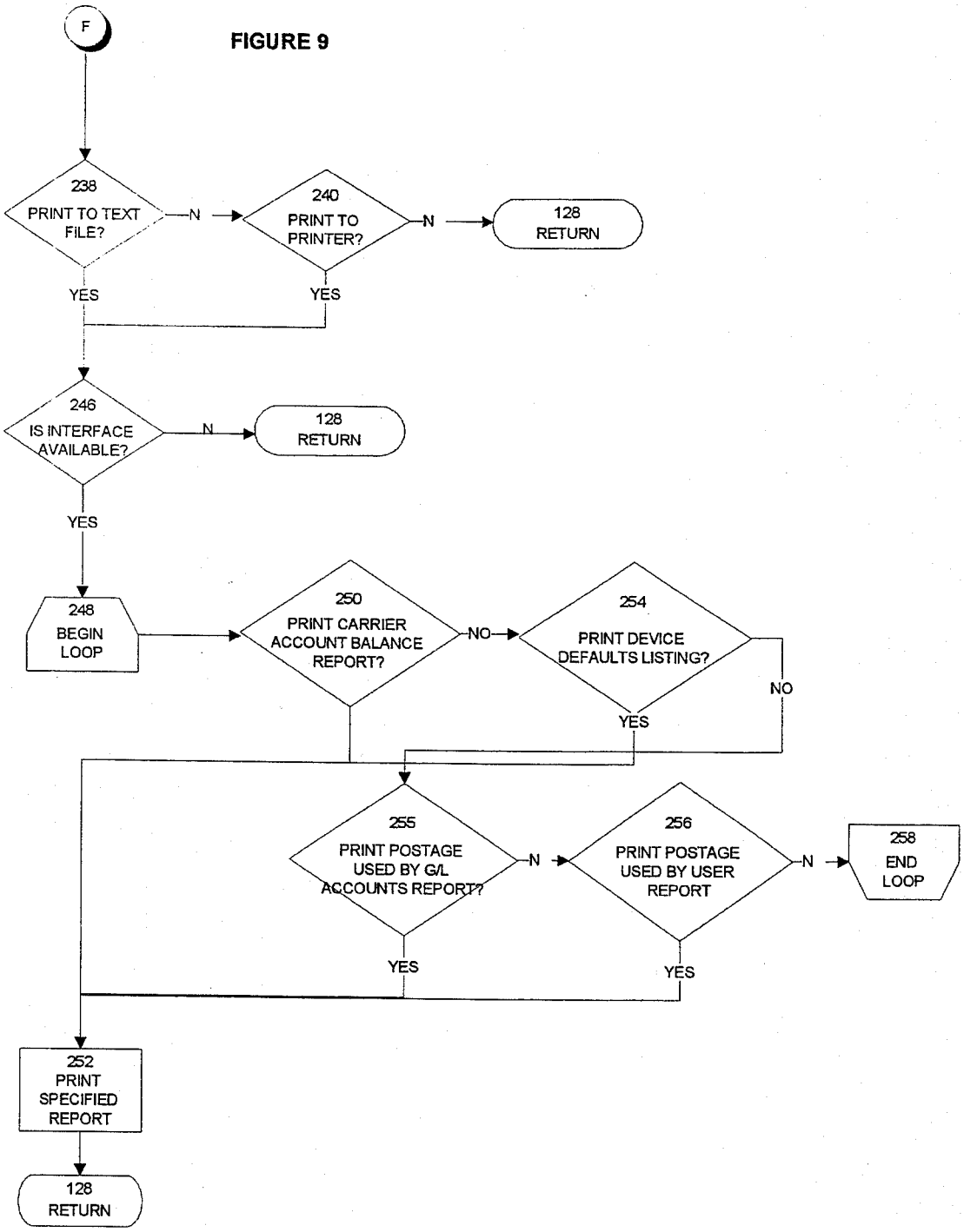
FIG. 9 is a flow chart showing details of the REPORTS function of FIG. 3.

Now referring to FIG. 9, the REPORTS function 110 is shown therein. The logic which follows reflects the interrogation of initial system readiness for report function printing by first ascertaining a report sending capacity at the computer. The CPU 52 determines at the PRINT TO TEXT FILE? block 238 or at PRINT TO PRINTER? block 240 whether or not such capacity is available. Upon failing to receive confirmation at either block, the user is returned to main menu, FIG. 3, through RETURN block 128. Next the interrogation proceeds by the CPU 52 further ascertaining report sending capacity by determining again at the IS INTERFACE AVAILABLE? block 246 whether or not initial system readiness is present. Upon failing to receive confirmation at this block, the user is again returned to main menu, FIG. 3, through RETURN block 128. If, however, the response at the PRINT TO TEXT FILE? block 238 or at PRINT TO PRINTER? block 240 and again at the IS INTERFACE AVAILABLE? block 246 is confirmatory, the report function subsystem menu is entered at BEGIN LOOP block 248. At this point, various report categories are presented to the system in a sequential loop for selection by the user. Upon selection of PRINT CARRIER ACCOUNT BALANCE REPORT? block 250 and confirmation at PRINT SPECIFIED REPORT block 252, the selected report is printed and then the user is returned to main menu, FIG. 3, through RETURN block 128. Likewise, upon selection of PRINT DEVICE DEFAULTS LISTING? block 254 and confirmation at PRINT SPECIFIED REPORT block 252, the selected report is printed and then the user is returned to main menu, FIG. 3, through RETURN block 128. Again likewise, upon selection of PRINT POSTAGE USED BY G/L ACCOUNTS REPORT? block 255 and confirmation at PRINT SPECIFIED REPORT block 252, the selected report is printed and then the user is returned to main menu, FIG. 3, through RETURN block 128. Yet again likewise, upon selection of PRINT POSTAGE USED BY USER REPORT? block 256 and confirmation at PRINT SPECIFIED REPORT block 252, the selected report is printed and then the user is returned to main menu, FIG. 3, through RETURN block 128. The selection ends at END LOOP block 258 at which point the user is returned to BEGIN LOOP block 248 and the user may select again one of the options as described above.

Reference is now made to FIG. 10 in which the PROGRAMING menu 112 is shown. This subsystem establishes all the predetermined settings or defaults employed during the QUICK PRINT mode 100 and in other modes of the system where the defaults are accepted for the particular application at hand. The subsystem menu is constructed for scrolling through the various prompts using an arrow, key or other designated indicator. The subsystem menu is entered at the BEGIN LOOP entry point 260. Thereafter, the system presents the PROGRAMING menu 112 by listing various functional categories, the first of which is a USER DEFAULTS category 262. The submenu for this category is presented in detail in FIG. 11. Continuing through the loop, the second prompt is a USER category 264 at which user information is presented. The submenu for this category is presented in detail in FIG. 12. The option that follows is POSTAGE ACCOUNTS function 266 and, if the user opts for this function, the user continues to FIG. 13. The option that follows is COUNTRY function 268 and, if the user opts for this function, the user continues to FIG. 14. The option that follows is COMPUTER INTERFACE function 270 and, if the user selects this option he continues to FIG. 15. The option that follows is PASSWORD PROTECTION function 272 and, if the user selects this function, the user continues to FIG. 16. The option that follows is ACCOUNT CODES function 274 and, if the user selects this option, the user continues to FIG. 17. The option that follows is DATE/TIME SET function 276 and, if the user selects this option, the user continues to FIG. 18. The option that follows is CARRIERS function 278 and, if the user selects this function, the user continues to FIG. 19. The option that follows is GRAPHICS function 280 and, if the user selects this option, the user continues to FIG. 20. The scrolling ends at END LOOP block 282 at which point the user is returned to BEGIN LOOP block 260 and the user may scroll again through the options as described above.

Now referring to FIG. 11, the USER DEFAULTS (UD) menu 262 is shown. The system provides for entry into the user default loop at BEGIN LOOP (UD) block 284. The subsystem menu is constructed for scrolling through the various prompts using an arrow, key or other designated indicator. The first prompt is COUNTRY (UD) option 286. If the user opts to run this function, the user continues proceed to FIG. 21 to COUNTRY DEFAULT function. Continuing through the loop the second option prompt is GRAPHIC (UD) option 288. If the user selects this option, the user then proceeds to GRAPHICS DEFAULT option, FIG. 22. The option that follows is CARRIER (UD) function 290 and if the user opts for this function, the user continues to CARRIER DEFAULT function, FIG. 23. The next prompt is POSTAL ACCOUNT (UD) option 292 and if the user selects this option he continues to the POSTAL ACCOUNT DEFAULT function, FIG. 24. The last prompt is ACCOUNT CODE (UD) option 294 and upon selection, the user continues to ACCOUNT CODE DEFAULT function, FIG. 25. The scrolling ends at END LOOP (UD) block 296 at which point the user is returned to BEGIN LOOP (UD) block 284 and the user may scroll again through the options as described above.

Figure 12:
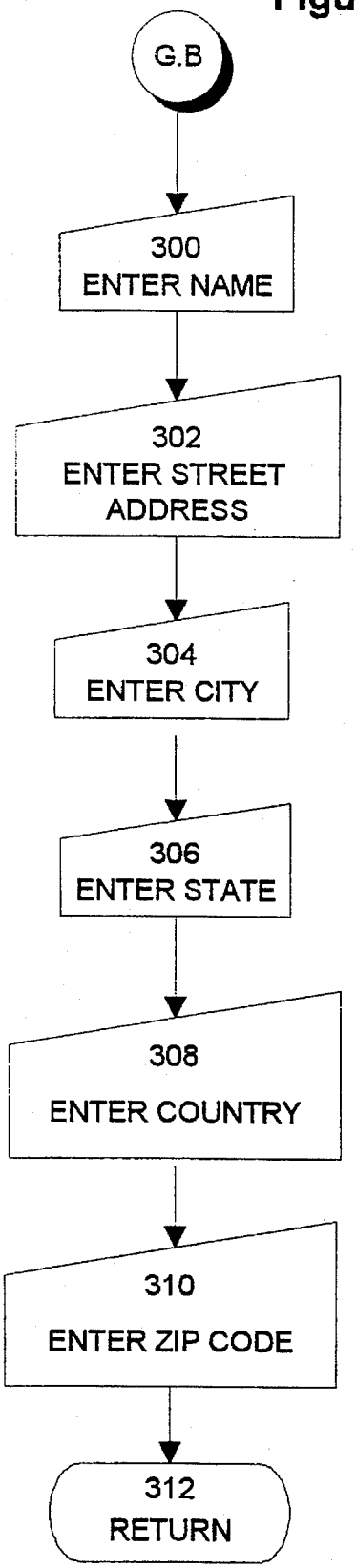
FIG. 12 is a flow chart showing details of the USER function of FIG. 10.

In FIG. 12, the USER INFORMATION function 264 is shown. The system prompts at ENTER NAME block 300 to enter the name of the user. After entering the name of the user, an ENTER STREET ADDRESS prompt 302 requests the entry of the street address. After entering the street address, an ENTER CITY prompt 304 requests the entry of the city. After entering city, an ENTER STATE prompt 306 requests the entry of the state. After entering state, an ENTER COUNTRY prompt 308 requests the entry of the country. After entering the country, an ENTER ZIP CODE prompt 310 requests the entry of the zip code. After entering the zip code, the system provides at PM RETURN block 312 for return to the Programming Menu, FIG. 10.

Figure 13:
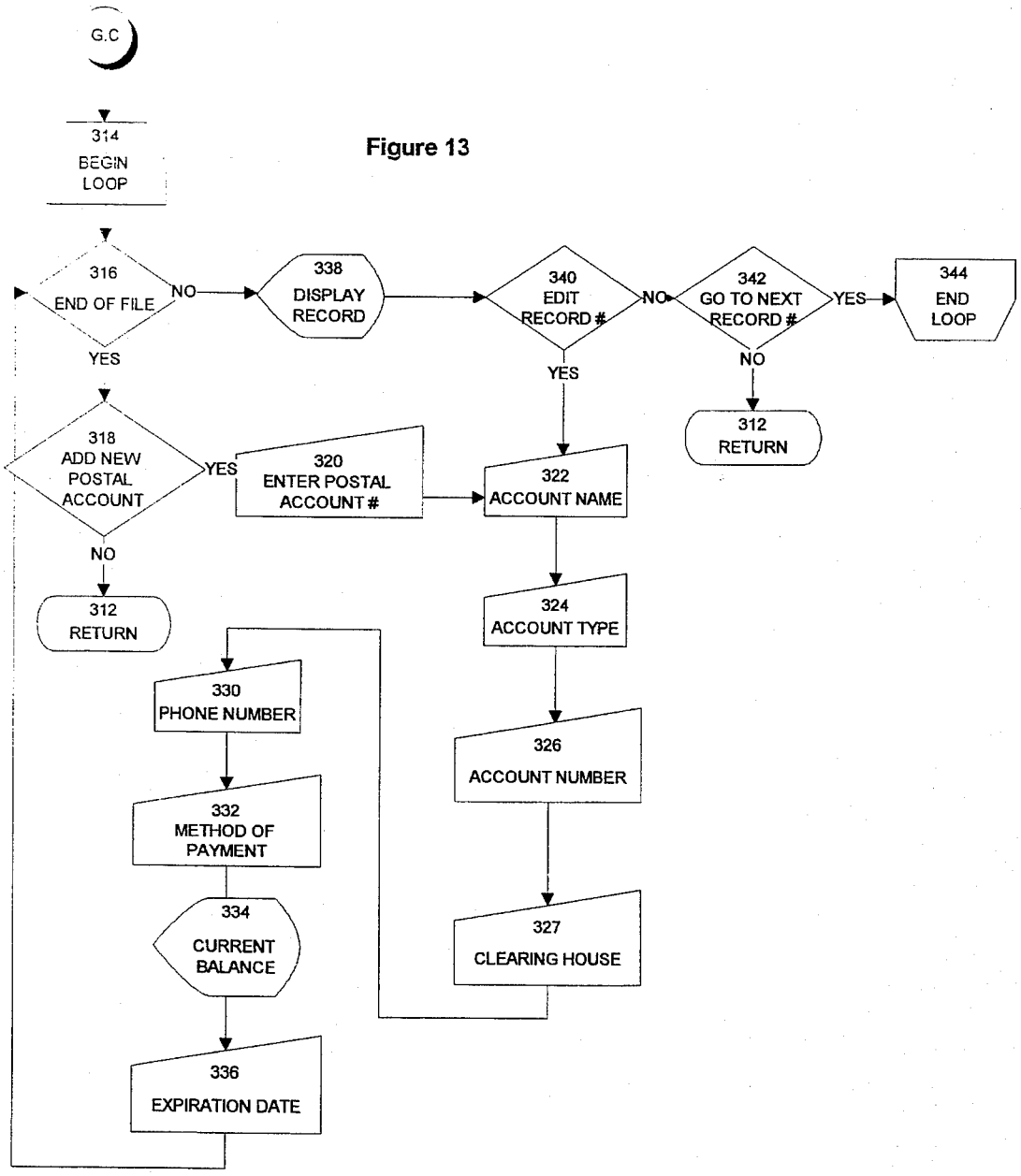
FIG. 13 is a flow chart showing details of the POSTAGE ACCOUNTS function of FIG. 10.

With the POSTAGE ACCOUNT menu 266, FIG. 13, the programing loop thereof is entered at the BEGIN LOOP block 314. Before any initial data is entered, the CPU 52 ascertains if a file empty condition exists by checking an END OF FILE pointer 316. Upon verifying a file empty condition, the system provides an ADD NEW POSTAL ACCOUNT prompt 318. Upon the user choosing not to add a new postal account, the system returns the user through PM RETURN block 312 to the Programming menu to FIG. 10. If the user chooses to add a new record, the system provides an ENTER ACCOUNT # prompt 320, which is followed by a postal ACCOUNT NAME prompt 322. The system next provides an ACCOUNT TYPE prompt 324. After entering the account type, the system provides an ACCOUNT NUMBER prompt 326. After entering the account number, the system provides a CLEARING MOUSE prompt 328. After entering the clearing house, the system provides a PHONE NUMBER prompt 330. After entering the phone number, the system provides a METHOD OF PAYMENT prompt 332. After entering the method of payment, the system provides a CURRENT BALANCE display 334. After the current balance is displayed, the system provides an EXPIRATION DATE prompt 336 which requests the entry of the expiration date. Thereafter, the END OF FILE pointer 316 is reset so that when the user returns to BEGIN LOOP block 314, the information just entered is displayed. If the CPU 52 determines that the file is not empty (at 316, above), at DISPLAY RECORD block 338 the existing postal account record is displayed. The system then provides an EDIT RECORD # query 340 asking the user to edit a specified record. This allows the editing of a specified postal account record. If the user decides not to edit the current record, the system provides a GO TO NEXT RECORD # prompt 342. If the user elects not to go to the next record number, the system through a PM RETURN block 312 returns the user to Progrming Menu, FIG. 10. If the user chooses to go to the next record number, the system pathway continues through END LOOP block 344 and BEGIN LOOP block 314 until END OF FILE prompt 316 is reached.

Figure 14:
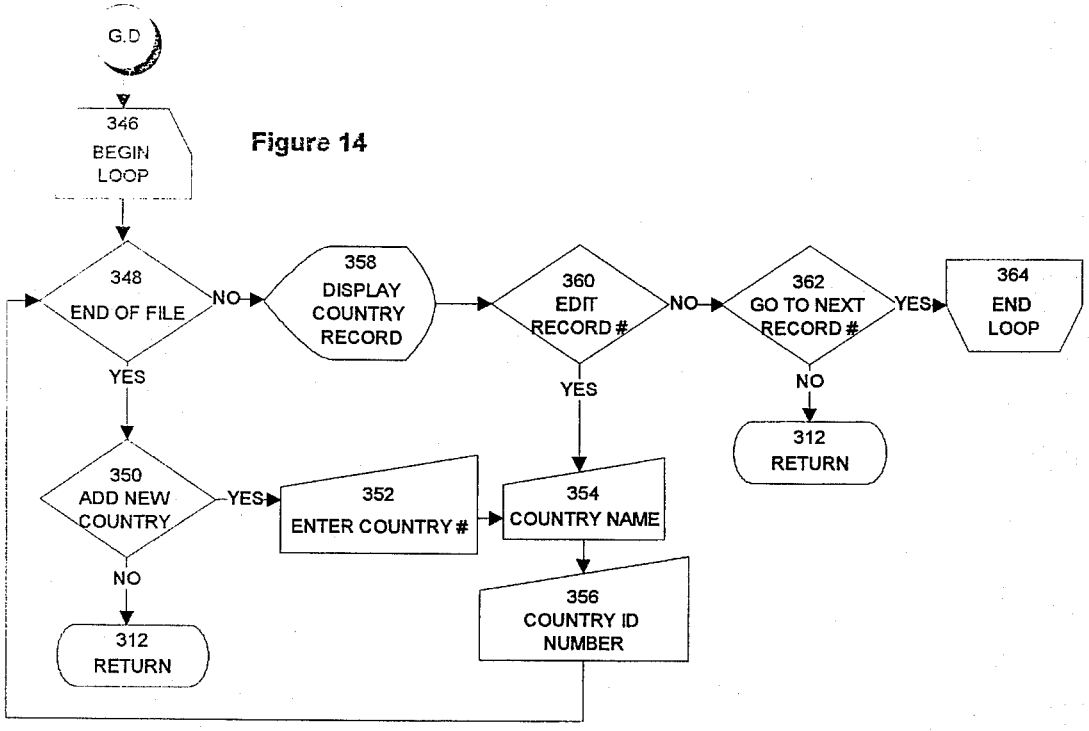
FIG. 14 is a flow chart showing details of the COUNTRY function of FIG. 10.

Now referring to FIG. 14, the COUNTRY code menu 268 is next shown. The system provides a BEGIN LOOP block 346 for the user to enter the loop. Prior to any data entry, the CPU 52 views an END OF FILE pointer 348 to ascertain a file empty status. If the file is empty, the system provides an ADD NEW COUNTRY prompt 350. If the user chooses not to add a new country code, the system returns the user through a PM RETURN block 312 to Programming Menu, FIG. 10. If the user chooses to add a new record, the system provides an ENTER COUNTRY # prompt 352 which is followed by a COUNTRY NAME prompt 354. After entering the country number and name, the system provides a COUNTRY ID NUMBER prompt 356. Thereafter, the END OF FILE pointer 348 is reset so that when the user returns to BEGIN LOOP block 346, the information just entered is displayed. When the END OF FILE pointer 348 is checked and if the file is not empty, the country code record is displayed at COUNTRY RECORD display 358, the system then provides an EDIT RECORD # prompt 360. A YES response at EDIT RECORD # prompt 360, allows the editing of a specific country code record which proceeds similarly to ADD NEW COUNTRY prompt 350, by proceeding through COUNTRY NAME block 354 and COUNTRY ID NUMBER block 356 and finally resetting END OF FILE pointer 348. If the user does not to edit the current record, the system provides a GO TO NEXT RECORD # prompt 362. If the user does not go to the next record number, the system through a PM RETURN block 312 returns the user to Programing Menu, FIG. 10. If the user goes to the next record number, the system continues through END LOOP block 364 and BEGIN LOOP block 346 until END OF FILE prompt 348 is reached.

Figure 15:
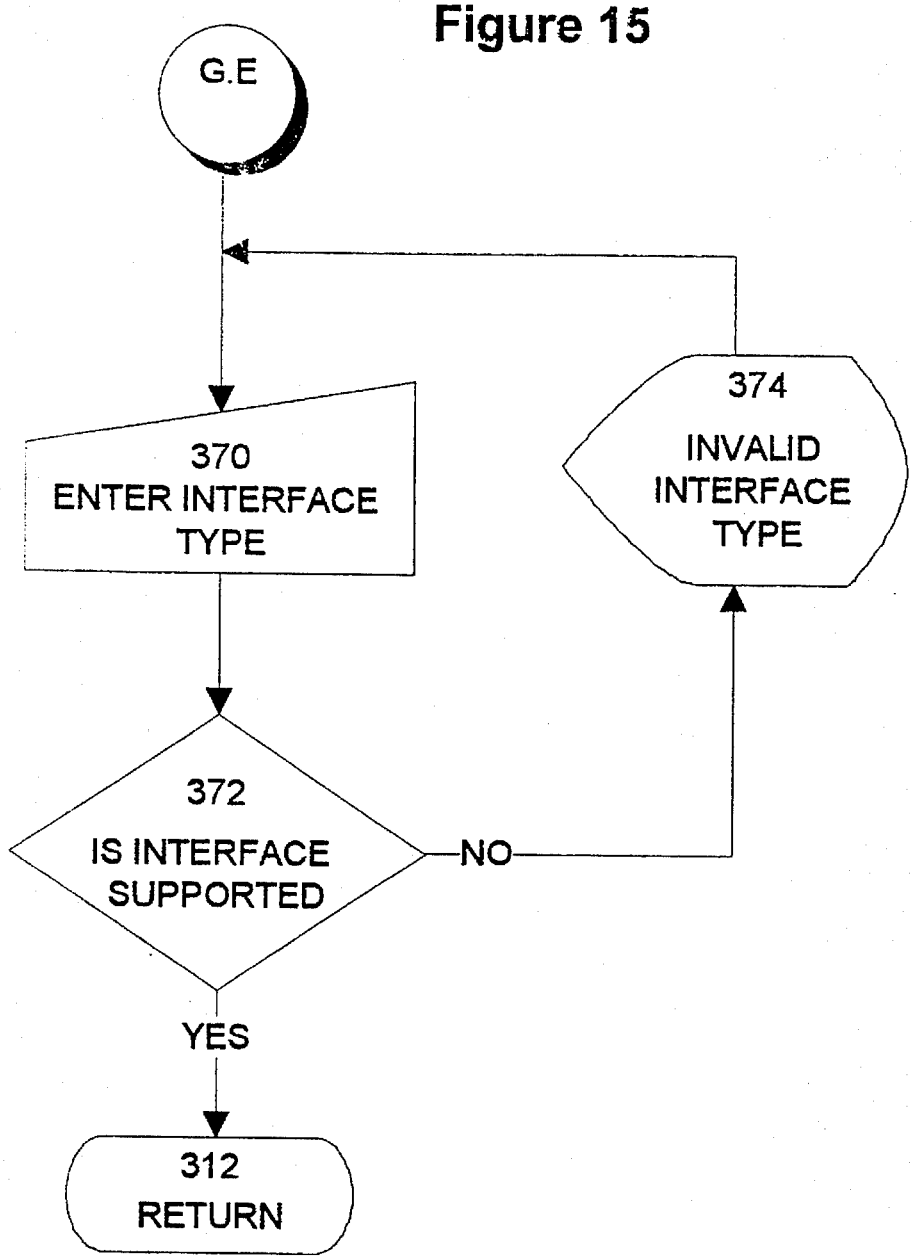
FIG. 15 is a flow chart showing details of the COMPUTER INTERFACE function of FIG. 10.

Now referring to FIG. 15, the COMPUTER INTERFACE type function 270 is shown. The system provides an ENTER INTERFACE TYPE prompt 370. Upon data entry of the interface type, the system then provides an IS INTERFACE SUPPORTED query 372 to CPU 52 which thereupon validates the computer interface support. If the computer interface is not supported, the system provides an INVALID INTERFACE TYPE error message 374 display. The user is then returned to ENTER INTERFACE TYPE prompt 370 to reenter the interface type. If a null character is entered or if a valid interface type has been entered and stored in memory, the user through a PM RETURN block 312 is returned to Programing Menu, FIG. 10.

Figure 16:
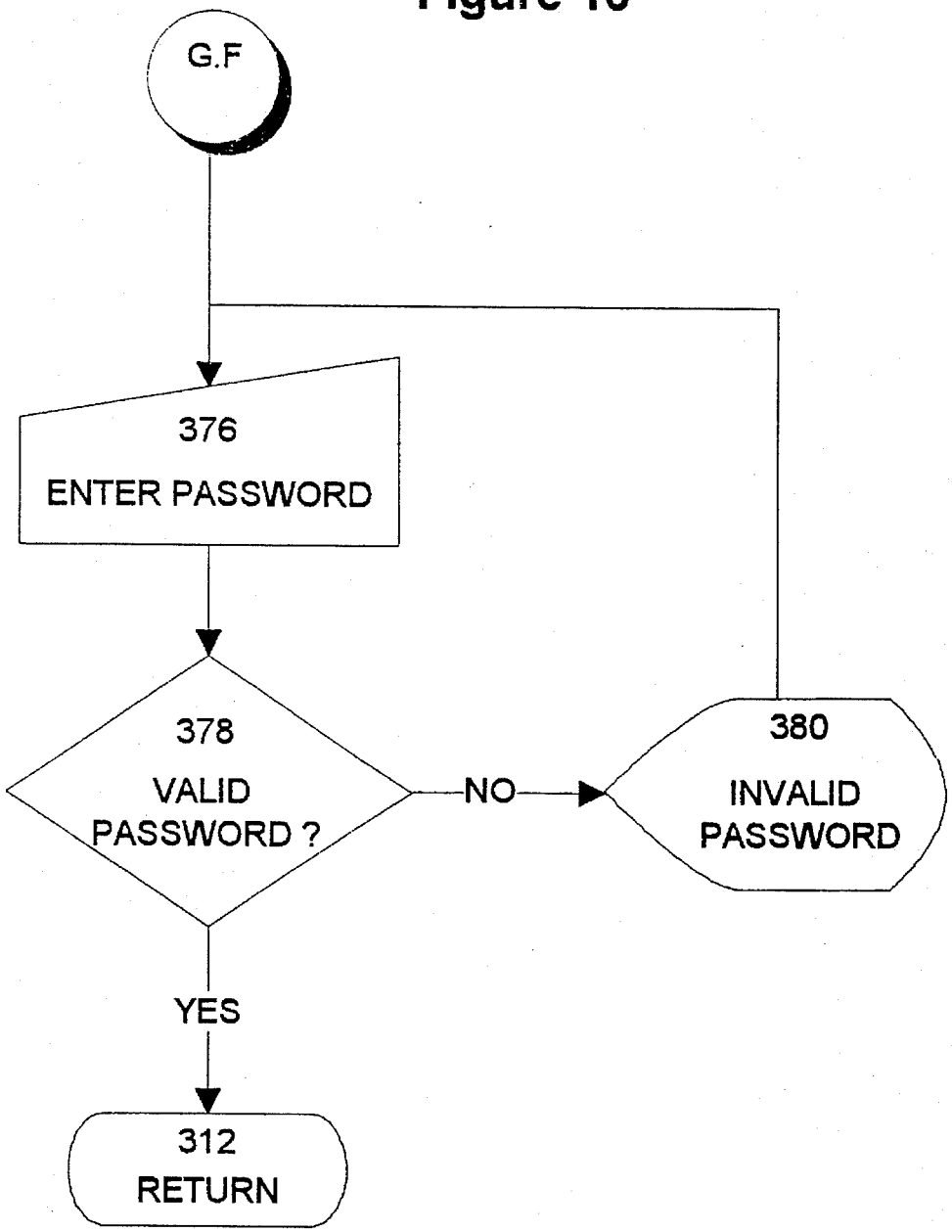
FIG. 16 is a flow chart showing details of the PASSWORD PROTECTION function of FIG. 10.

Now referring to FIG. 16, the PASSWORD PROTECTION function 272 is shown. The system provides an ENTER PASSWORD prompt 376. Upon entry of the password, the system then provides an VALID PASSWORD? query 378 to CPU 52 which thereupon validates the password supplied. If the password is not valid, the system provides an INVALID PASSWORD error message 380 display. The user is then returned to ENTER PASSWORD prompt 376 to re-enter the password. If a null character is entered or if a valid password has been entered and stored in memory, the user through a PM RETURN block 312 is returned to Programing Menu, FIG. 10.

Figure 17:
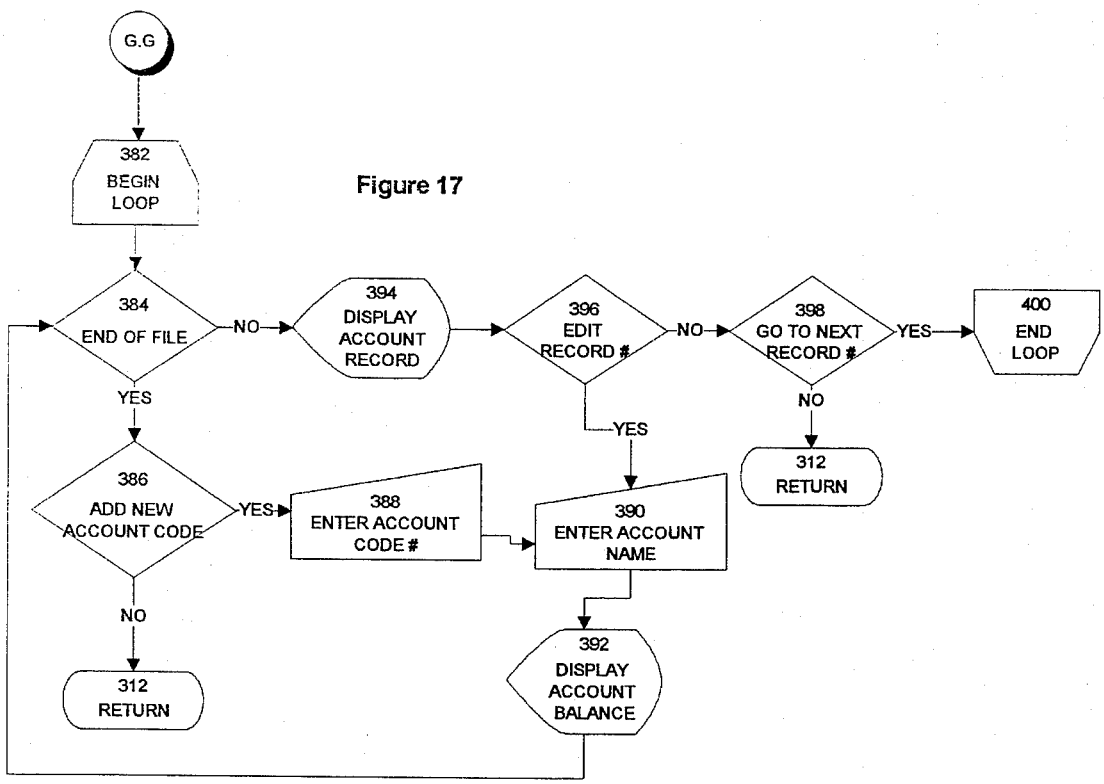
FIG. 17 is a flow chart showing details of the ACCOUNT CODES (programing mode) function of FIG. 10.

The ACCOUNT CODES function 274 is now shown in FIG. 17. The system provides a BEGIN LOOP block 382 for the user to enter the loop. Prior to any data entry, the CPU 52 views an END OF FILE pointer 384 to ascertain a file empty status. If the file is empty, the system provides an ADD NEW ACCOUNT CODE prompt 386. If the user chooses not to add a new account code, the system returns the user through a PM RETURN block 312 to Programming Menu, FIG. 10. If the user chooses to add a new record, the system provides an ENTER ACCOUNT CODE # prompt 388 which is followed by an ENTER ACCOUNT NAME prompt 390. After entering the account number and name, the system provides an DISPLAY ACCOUNT BALANCE display 392 and then returns the user to BEGIN LOOP block 382. When the END OF FILE pointer 384 is checked and if the file is not empty, the account code record is displayed at ACCOUNT RECORD display 394, the system then provides an EDIT RECORD # prompt 396. A YES response at EDIT RECORD # prompt 396, allows the editing of a specific account code record which proceeds similarly to ADD NEW ACCOUNT CODE prompt 388, by proceeding through ENTER ACCOUNT NAME block 390 and DISPLAY ACCOUNT BALANCE block 392 and finally resetting END OF FILE pointer 384. If the user does not to edit the current record, the system provides a GO TO NEXT RECORD # prompt 398. If the user does not go to the next record number, the system through a PM RETURN block 312 returns the user to Programing Menu, FIG. 10. If the user goes to the next record number, the system continues through END LOOP block 400 and BEGIN LOOP block 382 until END OF FILE prompt 384 is reached.

Figure 18:
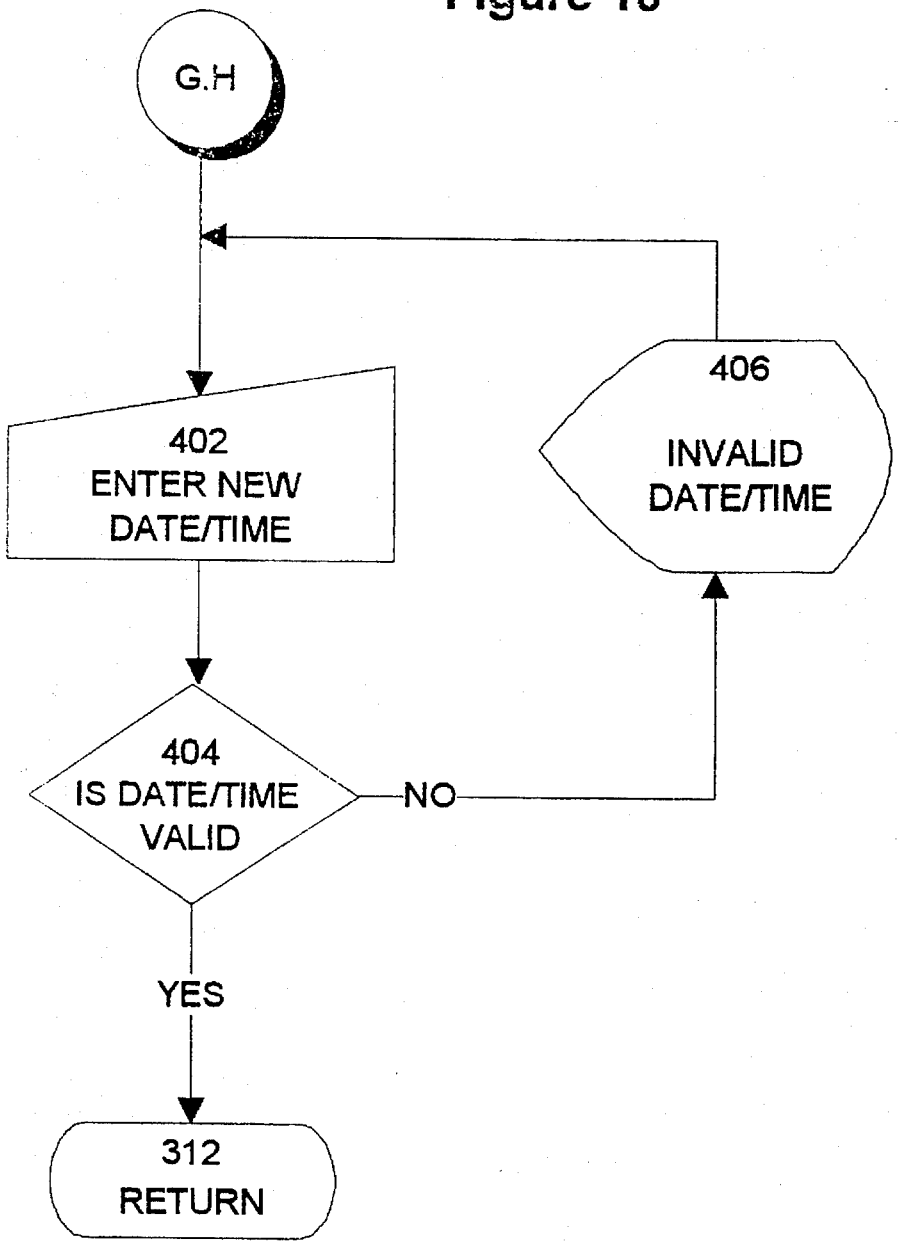
FIG. 18 is a flow chart showing details of the TIME/DATE SET function of FIG. 10.

Now referring to FIG. 18, the DATE/TIME SET function 276 is shown. The system provides an ENTER NEW DATE/TIME prompt 402. Upon entry of the date and time, the system then provides an IS DATE/TIME VALID query 404 to CPU 52 which thereupon validates the information supplied. If the date and time are not valid, the system provides an INVALID DATE/TIME error message 406 display. The user is then returned to ENTER NEW DATE/TIME prompt 402 to reenter the date/time information. If a null character is entered or if valid information has been entered and stored in memory, the user through a PM RETURN block 312 is returned to Programing Menu, FIG. 10.

Figure 19:
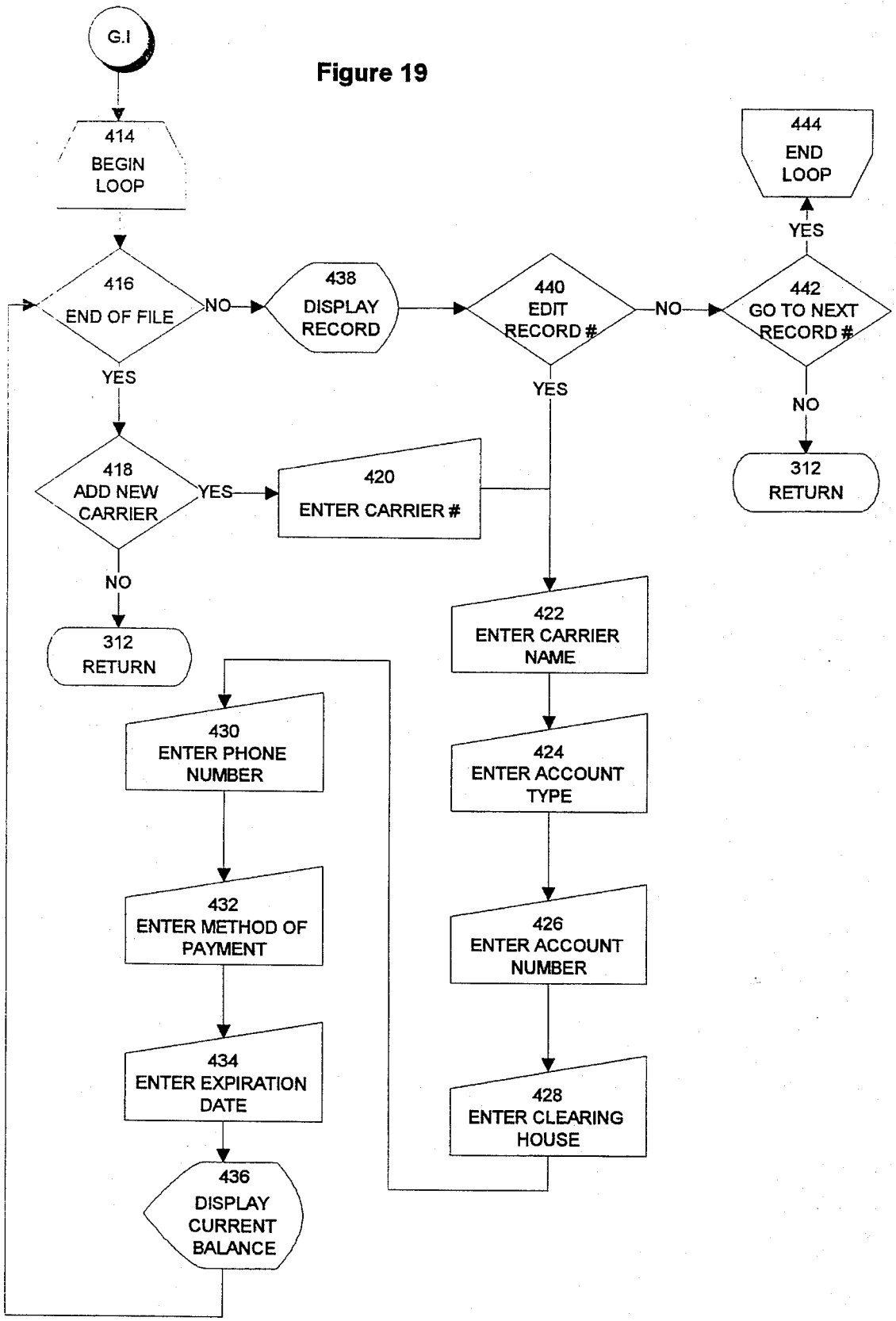
FIG. 19 is a flow chart showing details of the CARRIERS (programming mode) function of FIG. 10.

Now referring to FIG. 19, the postal CARRIERS menu 278 is next shown and described. The programing loop thereof is entered at the BEGIN LOOP block 414. Before any initial data is entered, the CPU 52 ascertains if a file empty condition exists by checking an END OF FILE pointer 416. Upon verifying a file empty condition, the system provides an ADD NEW CARRIER prompt 418. Upon the user choosing not to add a new carrier account, the system returns the user through PM RETURN block 312 to the Programming menu to FIG. 10. If the user chooses to add a new record, the system provides an ENTER CARRIER # prompt 420, which is followed by a postal ENTER CARRIER NAME prompt 422. The system next provides an ENTER ACCOUNT TYPE prompt 424. After entering the account type, the system provides an ENTER ACCOUNT NUMBER prompt 426. After entering the account number, the system provides an ENTER CLEARING MOUSE prompt 428. After entering the clearing house, the system provides an ENTER PHONE NUMBER prompt 430. After entering the phone number, the system provides an ENTER METHOD OF PAYMENT prompt 432. After entering the method of payment, the system provides an ENTER EXPIRATION DATE prompt 434 which requests the entry of the expiration date. After the expiration date is entered, the system provides a DISPLAY CURRENT BALANCE display 436. Thereafter, the user is returned to the BEGIN LOOP block 414. If the CPU 52 determines that the file is not empty (at 416, above), at DISPLAY RECORD block 438 the existing carrier record is displayed. The system then provides an EDIT RECORD # query 440 asking the user to edit a specified record. A YES response at EDIT RECORD # prompt 440, allows the editing of a specific carrier record which proceeds similarly to ADD NEW CARRIER prompt 418, by proceeding stepwise, as described supra through ENTER CARRIER NAME block 422 to DISPLAY CURRENT BALANCE block 436 and finally resetting END OF FILE pointer 416. If the user decides not to edit the current record, the system provides a GO TO NEXT RECORD # prompt 442. If the user elects not to go to the next record number, the system through a PM RETURN block 312 returns the user to Progrming Menu, FIG. 10. If the user chooses to go to the next record number, the system pathway continues through END LOOP block 444 and BEGIN LOOP block 414 until END OF FILE prompt 416 is reached.

Figure 20:
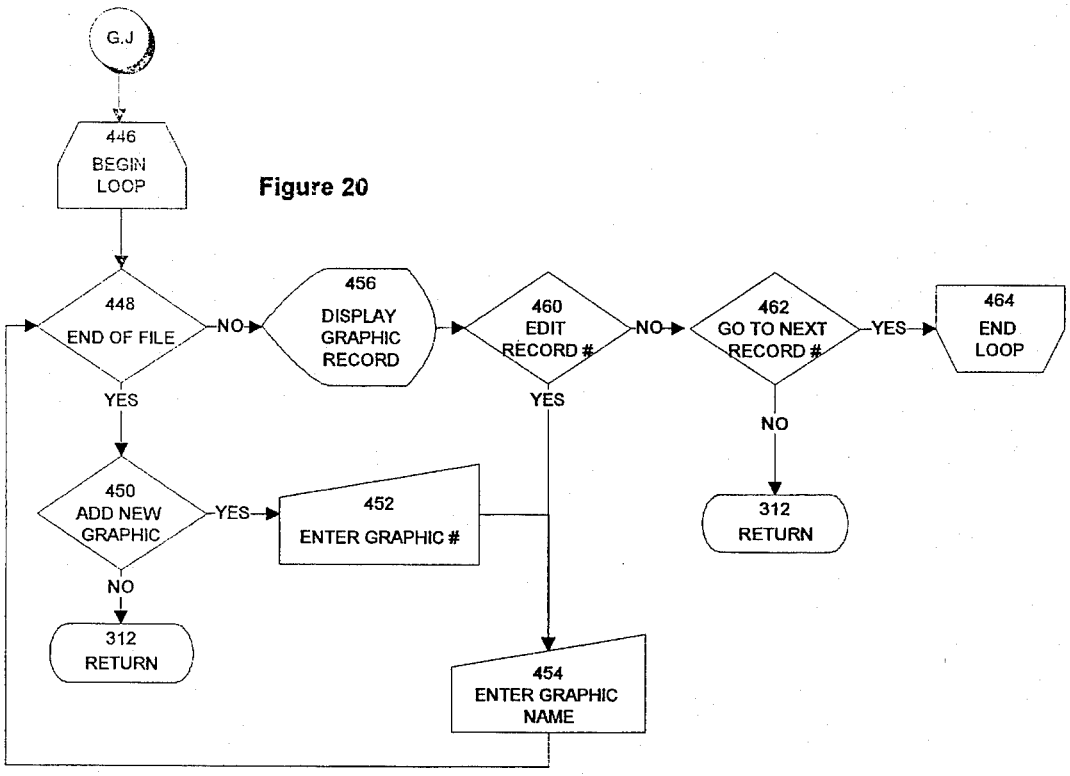
FIG. 20 ms a flow chart showing details of the GRAPHICS function of FIG. 10.

The GRAPHICS function 280 is now seen by referring to FIG. 20. The system provides a BEGIN LOOP block 446 for the user to enter the loop. Prior to any data entry, the CPU 52 views an END OF FILE pointer 448 to ascertain a file empty status. If the file is empty, the system provides an ADD NEW GRAPHIC prompt 450. If the user chooses not to add a new graphic, the system returns the user through a PM RETURN block 312 to Programming Menu, FIG. 10. If the user chooses to add a new graphic record, the system provides an ENTER GRAPHIC # prompt 452 which is followed by an ENTER GRAPHIC NAME prompt 454. After entering the graphic number and name, the system then returns the user to BEGIN LOOP block 446. When the END OF FILE pointer 448 is checked and if the file is not empty, the graphics record is displayed at GRAPHIC RECORD display 456, the system then provides an EDIT RECORD # prompt 460. A YES response at EDIT RECORD # prompt 460, allows the editing of a specific graphic code record which proceeds similarly to ADD NEW GRAPHIC prompt 450, by proceeding through ENTER GRAPHIC NAME block 454 and resetting END OF FILE pointer 448. If the user does not to edit the current record, the system provides a GO TO NEXT RECORD # prompt 462. If the user does not go to the next record number, the system through a PM RETURN block 312 returns the user to Programing Menu, FIG. 10. If the user goes to the next record number, the system continues through END LOOP block 464 and BEGIN LOOP block 446 until END OF FILE prompt 448 is reached.

Figure 21:
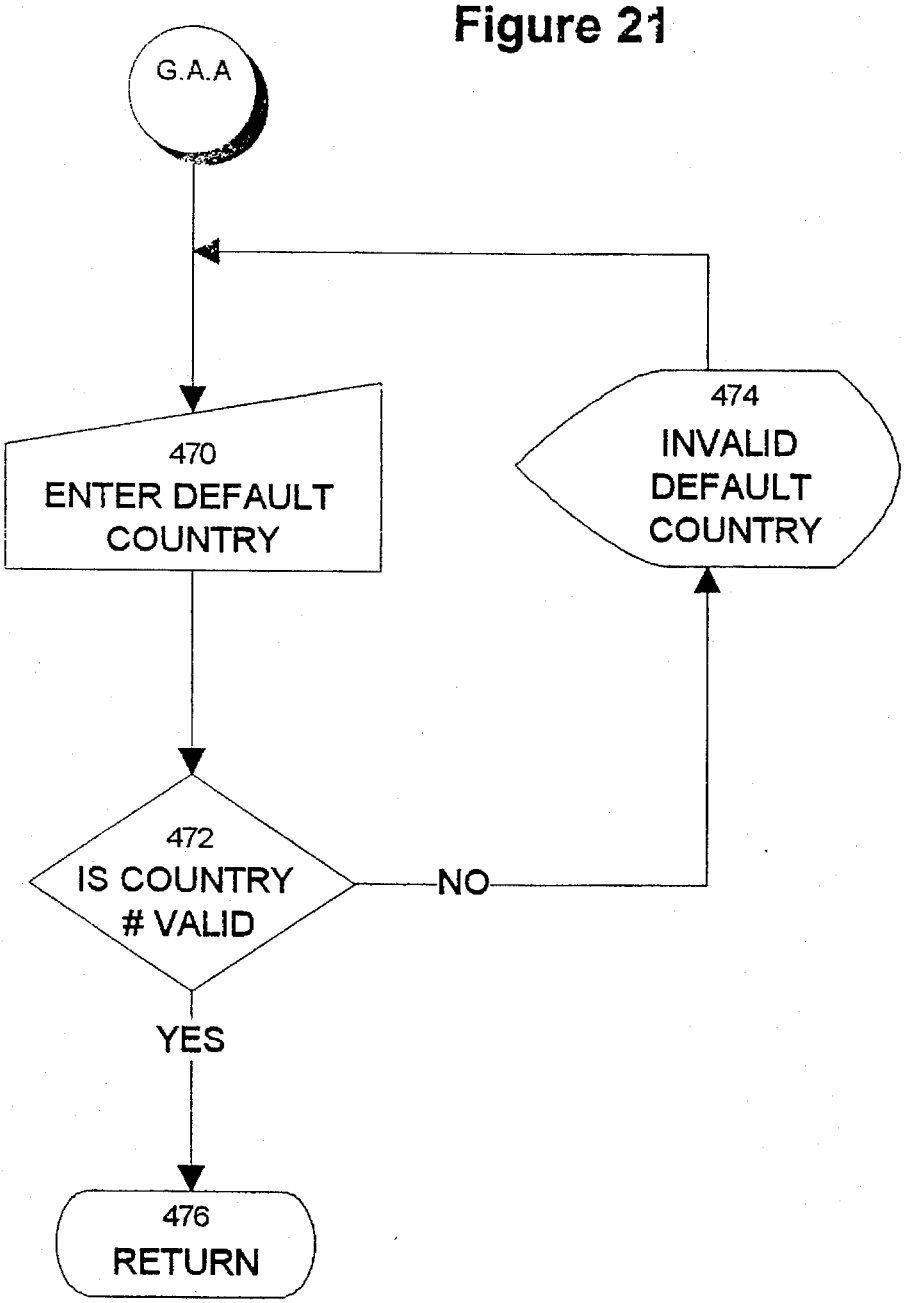
FIG. 21 ms a flow chart showing details of the COUNTRY function of FIG. 11.

Now referring to FIG. 21, the COUNTRY DEFAULT function 286 is shown. The system provides an ENTER DEFAULT COUNTRY prompt 470. Upon data entry of the default country number, the system then provides an IS COUNTRY # VALID query 472 to CPU 52 which thereupon validates the default country number. If the default country number is invalid, the system provides an INVALID DEFAULT COUNTRY error message 474 display. The user is then returned to ENTER DEFAULT COUNTRY prompt 470 to reenter the default country. If a null character is entered or if a valid default country has been entered and stored in memory, the user through a UD RETURN block 476 is returned to User Defaults Menu, FIG. 11.

Figure 22:
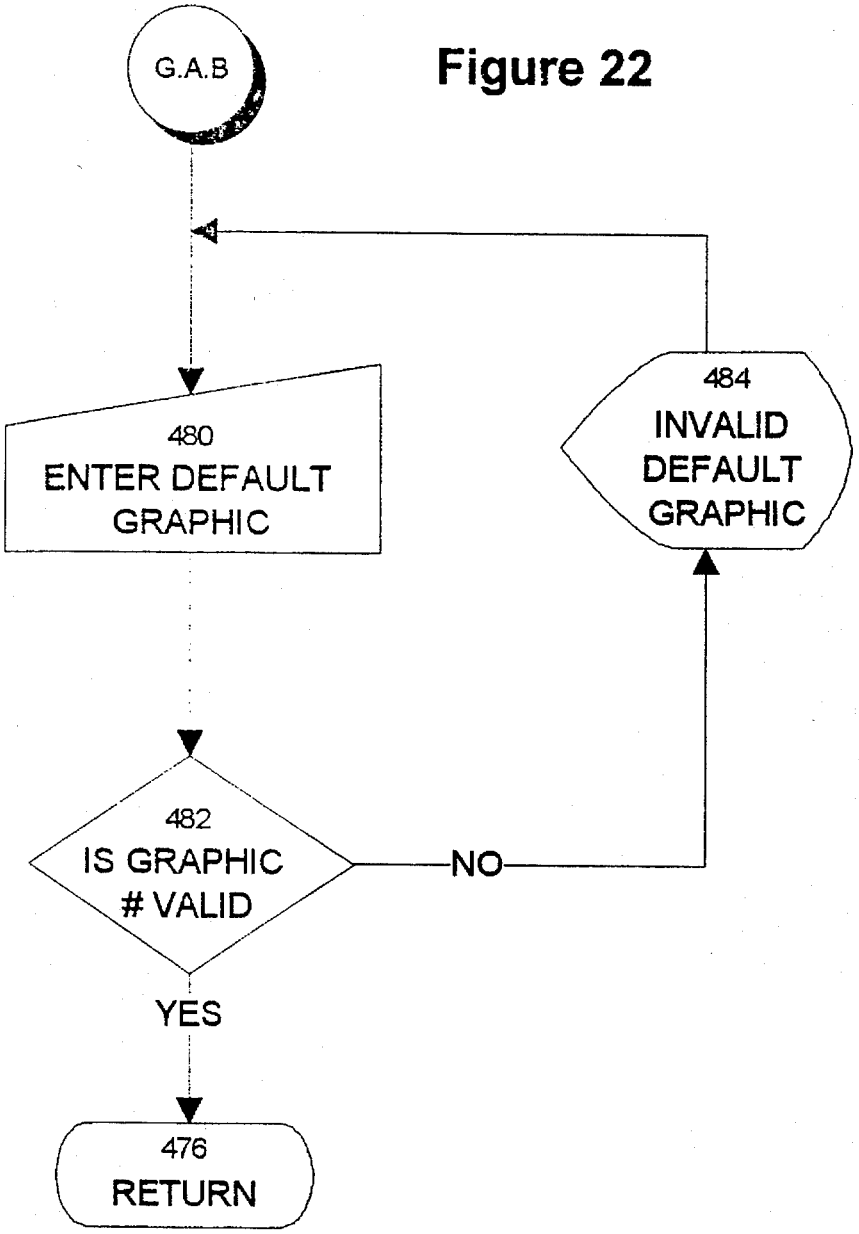
FIG. 22 is a flow chart showing details of the GRAPHIC function of FIG. 11.

In FIG. 22, the GRAPHIC DEFAULT function 288 is shown and is described in more detail hereinbelow. The system provides an ENTER DEFAULT GRAPHIC prompt 480. Upon data entry of the default graphic number, the system then provides an IS GRAPHIC # VALID query 482 to CPU 52 which thereupon validates the default graphic number. If the default graphic number is invalid, the system provides an INVALID DEFAULT GRAPHIC error message 484 display. The user is then returned to ENTER DEFAULT GRAPHIC prompt 480 to reenter the default graphic. If a null character is entered or if a valid default graphic has been entered and stored in memory, the user through a UD RETURN block 476 is returned to User Defaults Menu, FIG. 11.

Figure 23:
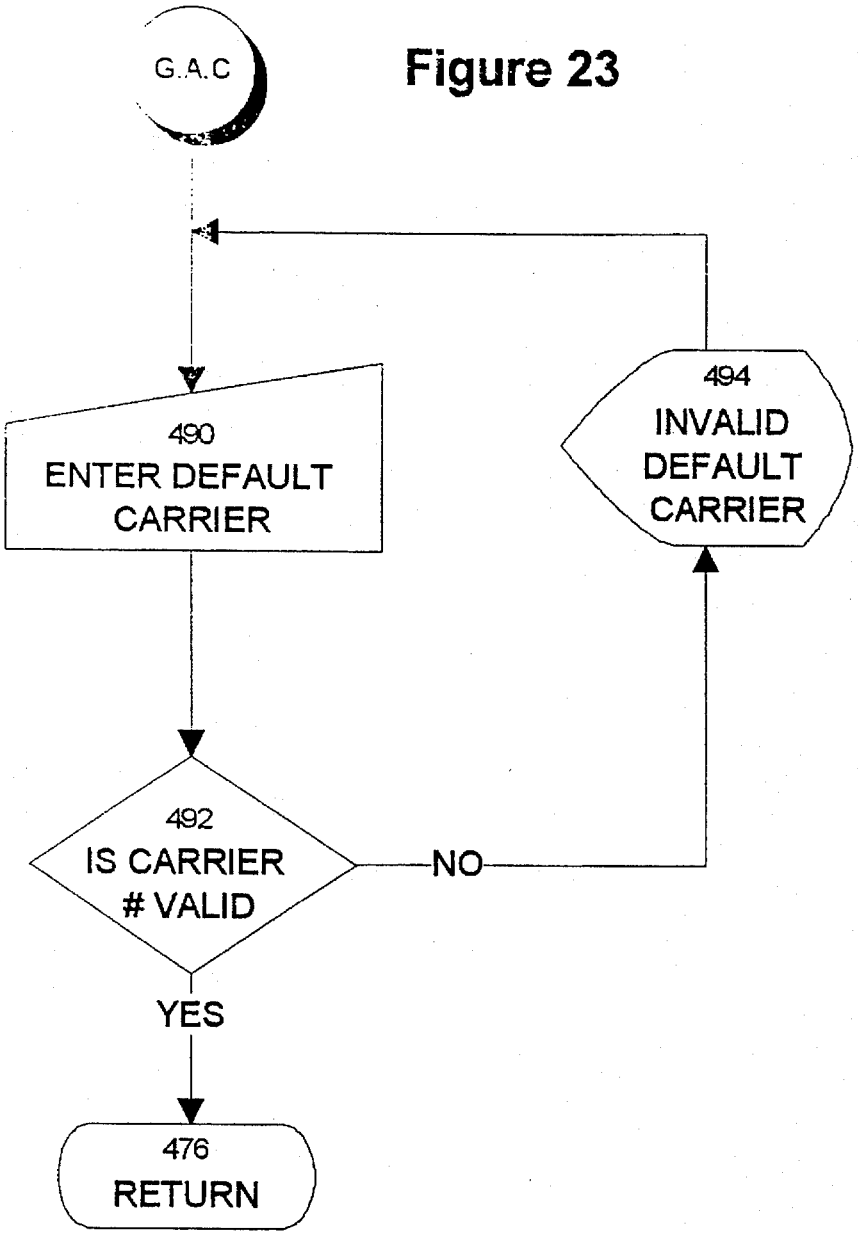
FIG. 23 is a flow chart showing details of the CARRIER function of FIG. 11.

Now referring to FIG. 23, the CARRIER DEFAULT function 290 is shown and is described in more detail hereinbelow. The system provides an ENTER DEFAULT CARRIER prompt 490. Upon data entry of the default carrier number, the system then provides an IS CARRIER # VALID query 492 to CPU 52 which thereupon validates the default carrier number. If the default carrier number is invalid, the system provides an INVALID DEFAULT CARRIER error message 494 display. The user is then returned to ENTER DEFAULT CARRIER prompt 490 to reenter the default carrier. If a null character is entered or if a valid default carrier has been entered and stored in memory, the user through a UD RETURN block 476 is returned to User Defaults Menu, FIG. 11.

Figure 24:
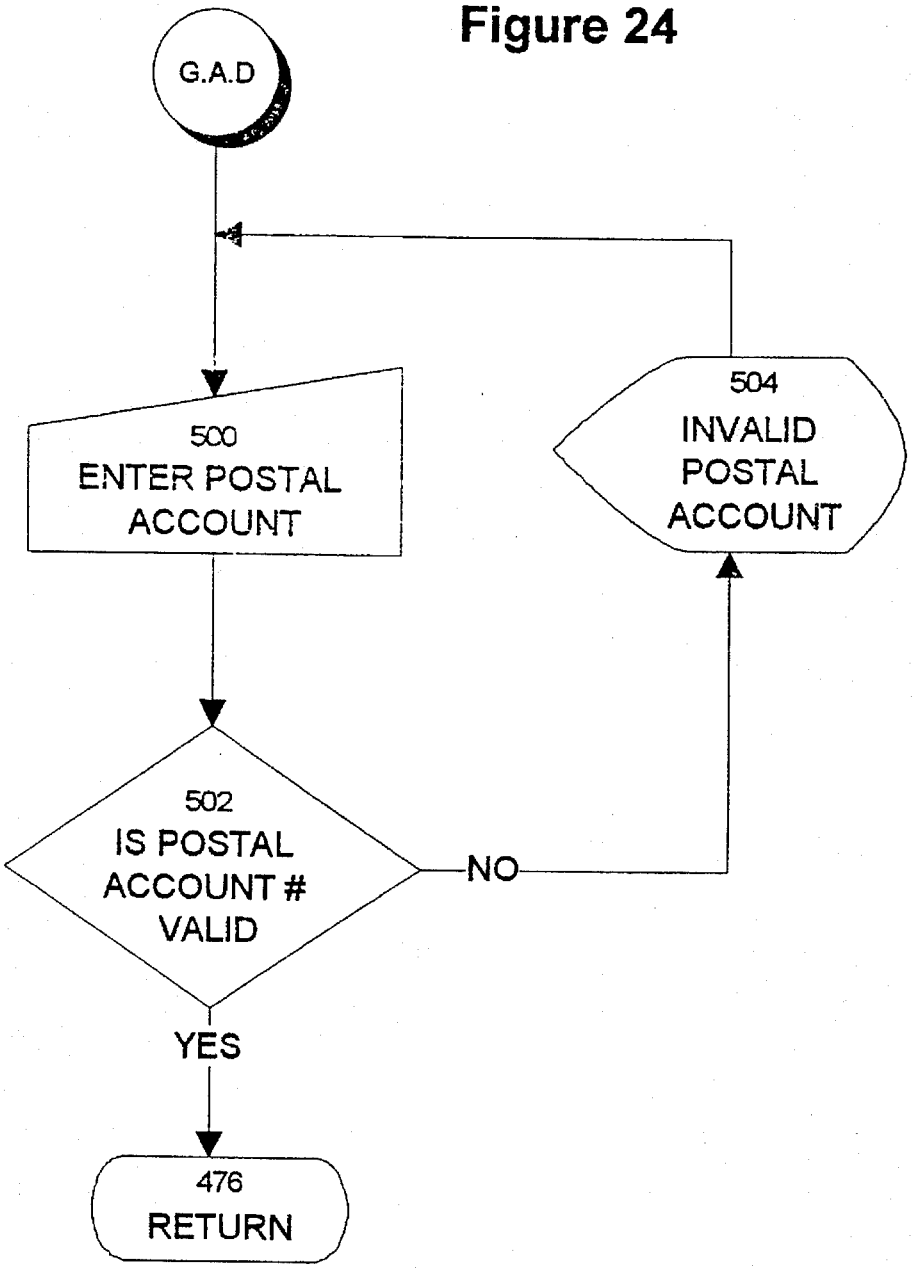
FIG. 24 ms a flow chart showing details of the POSTAL ACCOUNT function of FIG. 11; and, FIG. 25 ms a flow chart showing details of the ACCOUNT CODE function of FIG. 11.

Now referring to FIG. 24, the POSTAL ACCOUNT DEFAULT function 292 is shown. The system provides an ENTER POSTAL ACCOUNT prompt 500. Upon data entry of the default postal account number, the system then provides an IS POSTAL ACCOUNT # VALID query 502 to CPU 52 which thereupon validates the default postal account number. If the default postal account number is invalid, the system provides an INVALID DEFAULT POSTAL ACCOUNT error message 504 display. The user is then returned to ENTER DEFAULT POSTAL ACCOUNT prompt 500 to reenter the default postal account. If a null character is entered or if a valid default postal account has been entered and stored in memory, the user through a UD RETURN block 476 is returned to User Defaults Menu, FIG. 11.

Figure 25:
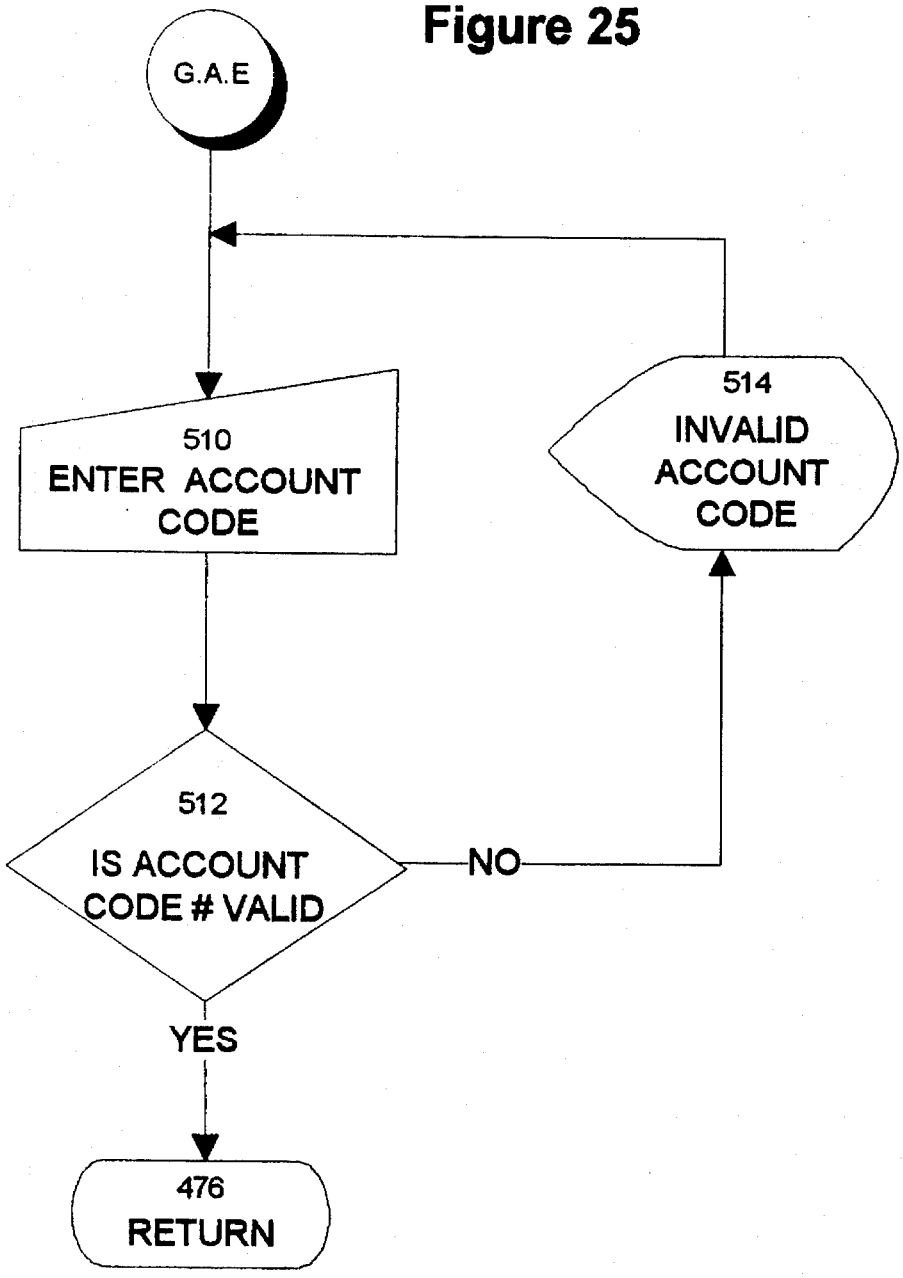

Now referring to FIG. 25, the ACCOUNT CODE DEFAULT function 294 is shown. The system provides an ENTER ACCOUNT CODE prompt 510. Upon data entry of the default account code number, the system then provides an IS ACCOUNT CODE # VALID query 512 to CPU 52 which thereupon validates the default account code number. If the default account code number is invalid, the system provides an INVALID DEFAULT ACCOUNT CODE error message 514 display. The user is then returned to ENTER ACCOUNT CODE prompt 510 to reenter the default account code. If a null character is entered or if a valid default account code has been entered and stored in memory, the user through a UD RETURN block 476 is returned to User Defaults Menu, FIG. 11.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A postage management system enabling the use of one of a plurality of carriers, said system for imprinting postage on postal and private courier parcels and envelopes, said system having a central processing unit (CPU), an operating system, and a user communications link, said postage management system comprising:

an embedded program in said CPU having a permanent portion and a configurable portion thereof, said configurable portion, in turn, comprising a postage rate database in said configurable portion with postal costs for a plurality of parcel and envelope configurations for each said carrier;

a postage service database in said configurable portion with specifications for a plurality of parcel and envelope configurations for each said carrier;

a management program in said configurable portion enabling the selection of one of said plurality of carriers based on predetermined parameters;

communications interface enabling, in cooperative functional relationship with said management program, the purchasing of postage through a clearing house; and, said permanent portion, in turn, further comprising:

a rate comparator program in functional cooperation with said management program, providing optimization of services.

2. A postage management system as described in claim 1 wherein said communications interface further includes a plurality accounts enabling, in cooperative functional relationship with said clearing house, the purchasing of postage through on a debit and on a credit basis.

3. A postage management system as described in claim 1 wherein said embedded program further includes an encryptor subprogram means for precluding access to the system by an unauthorized user, said encryptor means enabling, in cooperative functional relationship with said management program, the use of a password therefor.

4. A postage management system as described in claim 1 wherein said configurable portion further comprises a mode select means for selecting between operation in a credit mode and operating in a debit mode, said mode select means in cooperative functional relationship with said user program to pay the said courier selected by said rate comparator program.

5. A postage management system as described in claim 4 wherein said mode select means further comprises a credit mode for programmable and selective operation thereunder, said credit mode enabling the incrementing in cooperative functional relationship with said user program the account of said courier.

6. A postage management system as described in claim 5 wherein said credit mode further comprises a credit balance report for program operation, said credit balance report informing the user in cooperative functional relationship with said user program of the account status with said courier.

7. A postage management system as described in claim 4 wherein said mode select means further comprises a debit mode for programmable and selective operation thereunder, said debit mode enabling the decrementing in cooperative functional relationship with said user program the fund deposited with said courier.

8. A postage management system as described in claim 7 wherein said debit mode further comprises a debit balance report for program operation, said debit balance report informing the user in cooperative functional relationship with said user program of the undecremented fund with said courier.

9. A postage management system for a plurality of users adapted for the use with a plurality of carriers, said system for imprinting postage on postal and private courier parcels and envelopes, each said user of said system having a central processing unit (CPU) with an operating system and a communications link to a host computer, said postage management system comprising:

network means for interconnecting said plurality of users, said network means to said host computer;

an embedded program in said CPU having a permanent portion and a configurable portion thereof, said configurable portion, in turn, comprising:

a postage rate database in said configurable portion with postal costs for a plurality of parcel and envelope configurations for each said carrier;

a postage service database in said configurable portion with specifications for a plurality of parcel and envelope configurations for each said carrier;

a management program in said configurable portion enabling the selection of one of said plurality of carriers based on predetermined parameters;

said permanent portion, in turn, further comprising:

a rate comparator program in functional cooperation with said management program, providing optimization of services; and, said network means enabling, in cooperative functional relationship with said management program, the network wide franking of postage.

10. A postage management system for a plurality of users as described in claim 9, wherein said management program further comprises:

default subprogram means for establishing default parameters by predetermining the selection of any given country, the purchasing mechanism for private courier and postal service postage, the purchase account encoding mechanism, the computer interface and the date and time of usage.

11. A postage management system for a plurality of users as described in claim 10, wherein said default subprogram further comprises:

default subprogram means for establishing default parameters by further predetermining the selection of password protection and the user account encoding mechanism.

12. A postage management system for a plurality of users as described in claim 11, wherein said configurable portion further comprises a mode select means for selecting between operation in a credit mode and operating in a debit mode, said mode select means in cooperative functional relationship with said user program to pay the said courier selected by said rate comparator program.

13. A postage management system for a plurality of users as described in claim 12, wherein said mode select means further comprises a credit mode for programmable and selective operation thereunder, said credit mode enabling the incrementing in cooperative functional relationship with said user program the account of said courier.

14. A postage management system for a plurality of users as described in claim 13 wherein said credit mode further comprises a credit balance report for program operation, said credit balance report informing the user in cooperative functional relationship with said user program of the account status with said courier.

15. A postage management system for a plurality of users as described in claim 12 wherein said mode select means further comprises a debit mode for programmable and selective operation thereunder, said debit mode enabling the decrementing, in cooperative functional relationship with said user program, the fund deposited with said courier.

16. A postage management system for a plurality of users as described in claim 15 wherein said debit mode further comprises a debit balance report for program operation, said debit balance report informing the user in cooperative functional relationship with said user program of the undecremented fund with said courier.

17. A postage management system enabling the use of one of a plurality of carriers, said system for imprinting postage on postal and private courier parcels and envelopes, said system having a central processing unit (CPU), an operating system, and a user communications link, said postage management system comprising:

an embedded program in said CPU having a permanent portion and a configurable portion thereof, said configurable portion, in turn, comprising:

a postage rate database in said configurable portion with postal costs for a plurality of parcel and envelope configurations for each said carrier;

a postage service database in said configurable portion with specifications for a plurality of parcel and envelope configurations for each said carrier;

a management program in said configurable portion enabling the selection of one of said plurality of carriers based on predetermined parameters;

a user default parameter subprogram for enabling quick print operations, said default parameter subprogram entering predetermined selection requirements in said management program and thereby precluding the separate entry of each specification thereinto, said default parameter subprogram facilitating access for routine mailings;

said permanent portion, in turn, further comprising:

a rate comparator program in functional cooperation with said management program, providing optimization of services.

18. A postage management system as described in claim 17 wherein said embedded program further includes communications interface enabling, in cooperative functional relationship with said management program, the purchasing of postage through a clearing house.

19. A postage management system as described in claim 18 wherein said communications interface further includes a plurality accounts enabling, in cooperative functional relationship with said clearing house, the purchasing of postage through on a debit and on a credit basis.

* * * * *